US008640451B2

(12) United States Patent
Akiyama et al.

(10) Patent No.: US 8,640,451 B2
(45) Date of Patent: Feb. 4, 2014

(54) ENGINE CONTROL DEVICE, AND ITS CONTROL METHOD

(75) Inventors: Teruo Akiyama, Hiratsuka (JP); Hisashi Asada, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 935 days.

(21) Appl. No.: 12/522,683

(22) PCT Filed: Dec. 27, 2007

(86) PCT No.: PCT/JP2007/075180

§ 371 (c)(1),
(2), (4) Date: Mar. 15, 2010

(87) PCT Pub. No.: WO2008/087847

PCT Pub. Date: Jul. 24, 2008

(65) Prior Publication Data

US 2010/0167873 A1 Jul. 1, 2010

(30) Foreign Application Priority Data

Jan. 18, 2007 (JP) ..... 2007-009220

(51) Int. Cl.
*F02D 29/04* (2006.01)
*F02D 41/04* (2006.01)

(52) U.S. Cl.
USPC ..... 60/434; 60/431

(58) Field of Classification Search
USPC ..... 60/431, 434, 452
See application file for complete search history.

(56) References Cited

U.S. PATENT DOCUMENTS

| | | | | |
|---|---|---|---|---|
| 4,606,313 | A * | 8/1986 | Izumi et al. | 60/434 |
| 5,155,996 | A * | 10/1992 | Tatsumi et al. | 60/431 |
| 5,593,364 | A * | 1/1997 | Ishii et al. | 477/98 |
| 5,944,492 | A * | 8/1999 | Konishi et al. | 60/430 |
| 6,546,724 | B2 * | 4/2003 | Nishimura et al. | 60/431 |
| 7,228,233 | B2 * | 6/2007 | Kimura et al. | 701/301 |
| 7,543,448 | B2 * | 6/2009 | Nakamura et al. | 60/431 |
| 7,631,495 | B2 * | 12/2009 | Naruse | 60/434 |
| 7,729,859 | B2 * | 6/2010 | Kimura et al. | 701/301 |
| 2005/0288844 | A1 | 12/2005 | Kimura et al. | |

FOREIGN PATENT DOCUMENTS

| | | |
|---|---|---|
| JP | 2-291435 | 12/1990 |
| JP | 3-271534 | 12/1991 |

(Continued)

OTHER PUBLICATIONS

International Search Report; issued for PCT/JP2007/075180; 2 pages; dated Feb. 18, 2008.

*Primary Examiner* — Thomas E Lazo
(74) *Attorney, Agent, or Firm* — Fish & Richardson P.C.

(57) ABSTRACT

An engine control device includes an engine-driven variable displacement hydraulic pump, a hydraulic actuator driven by oil from the pump, a control valve which controls the oil discharged from the pump, and supplies the oil to and from the hydraulic actuator, pump displacement detecting means, command means for selecting and commanding variable command values, and setting means for setting a first target engine speed in accordance with a command value, and a second target engine speed lower than the first target engine speed based on the first target engine speed. When the pump displacement increases and exceeds a first predetermined pump displacement when the engine is controlled based on the second target engine speed, a target engine speed is changed from the second target engine speed to a third target engine speed higher than the second target engine speed and equal to or lower than the first target engine speed.

24 Claims, 11 Drawing Sheets

(56) References Cited

FOREIGN PATENT DOCUMENTS

| | | | | |
|---|---|---|---|---|
| JP | 4-258505 | | | 9/1992 |
| JP | 7-301312 | | | 11/1995 |
| JP | 10-273919 | | | 10/1998 |
| JP | 2001-329883 | | | 11/2001 |
| JP | 2001329883 | A | * | 11/2001 |
| JP | 2006-007926 | | | 1/2006 |

* cited by examiner

CONTROL FLOWCHART OF THE INVENTION

BLOCK DIAGRAM OF CONTROLLER

ENGINE CONTROL DEVICE, AND ITS CONTROL METHOD

TECHNICAL FIELD

The present invention relates to an engine control device and its control method for controlling an engine based on a set target engine speed of the engine, and more particularly to a control device and a control method of an engine for enhancing the amount of fuel consumed of an engine.

BACKGROUND ART

In a utility vehicle, when an engine load is engine rated torque or less, the torque is matched with an engine output torque in a high-speed control field in a torque diagram. For example, target engine speed is set in correspondence with setting of a fuel dial, and a high-speed control field corresponding to the set target engine speed is determined.

Alternatively, a high-speed control field is determined in correspondence with the setting in the fuel dial, and the target engine speed of the engine is set in accordance with the determined high-speed control field. Then, control for matching the engine load and the engine output torque is performed in the determined high-speed control field.

Generally, to increase the operation amount, many operators set the target engine speed such that it becomes equal to the rated engine speed of the engine or engine speed close to the rated engine speed in many cases. A field where the amount of fuel consumed of the engine, i.e., a field where fuel economy is excellent normally exists in a medium speed engine speed field or a high torque field on a torque diagram of the engine. Therefore, a high-speed control field which is determined between no-load high idling rotation to rated rotation is not an efficient field in terms of fuel economy.

Conventionally, to drive an engine in a fuel economy field, there is a known control device in which a value of the target engine speed and engine target output torque are previously set in association with each other in each operation mode, and a plurality of operation modes can be selected (see patent document 1 for example). According to the control device of this kind, when an operator selects a second operation mode, the engine speed can be set lower than that of a first operation mode, and fuel economy can be enhanced.

When the operation mode switching system as described above is used, however, the fuel economy cannot be enhanced if an operator operates the mode switching means one by one. If the engine speed of engine when the second operation mode is selected is set as a value of engine speed which is uniformly lowered from the engine speed of the engine when the first operation mode is selected, the following problem occurs if the second operation mode is selected. That is, the maximum speed of an operating device (operating machine, hereinafter) of a utility vehicle is lowered as compared with a case where the first operation mode is selected. As a result, the operation amount when the second operation mode is selected becomes smaller than that when the first operation mode is selected.

Patent Document 1: Japanese Patent Application Laid-Open No. 10-273919

DISCLOSURE OF THE INVENTION

Problem to be Solved by the Invention

To solve the problem of the conventional technique, the present invention provides a control device and a control method of an engine capable of controlling the engine based on a second target engine speed existing a rotation field side lower than that of a set first target engine speed when the engine output torque is low, and capable of controlling the engine such as to shift the second target engine speed to the first target engine speed when the engine is used in a state where the engine output torque is high. Especially, the fuel economy of an engine can be enhanced, and when the maximum speed of an operating machine is required, the engine can be controlled without lowering the maximum speed of the operating machine.

Means for Solving the Problem

That is, as an essential characteristic, a first specified invention provides an engine control device including at least one variable displacement hydraulic pump which is driven by an engine, at least one hydraulic actuator which is driven by discharge pressure oil from the variable displacement hydraulic pump, a control valve which controls the pressure oil discharged from the variable displacement hydraulic pump and supplies and discharges the pressure oil to and from the hydraulic actuator, and pump displacement detecting means for detecting a pump displacement of the variable displacement hydraulic pump, wherein the engine control device further comprises command means for selecting and commanding one of command values that can be variably commanded, and setting means for setting a first target engine speed in accordance with a command value commanded by the command means, and setting second target engine speed which is lower than the first target engine speed based on the set first target engine speed, wherein when the pump displacement detected by the pump displacement detecting means increases and exceeds a first predetermined pump displacement when the engine is controlled based on the second target engine speed, the target engine speed is changed from the second target engine speed to a third target engine speed which is higher than the second target engine speed and which is equal to or lower than the first target engine speed.

Further, the first specified invention of the application is mainly characterized in that it is prohibited to further change the third target engine speed for a predetermined time after the target engine speed is changed to the third target engine speed.

Further, the first specified invention of the application is mainly characterized in that the relation between the third target engine speed and the first target engine speed are specified.

As an essential characteristic, a second specified invention provides an engine control device including at least one variable displacement hydraulic pump which is driven by an engine, at least one hydraulic actuator which is driven by discharge pressure oil from the variable displacement hydraulic pump, a control valve which controls the pressure oil discharged from the variable displacement hydraulic pump and supplies and discharges the pressure oil to and from the hydraulic actuator, and pump displacement detecting means for detecting a pump displacement of the variable displacement hydraulic pump, wherein the engine control device further comprises command means for selecting and commanding one of command values that can be variably commanded, and setting means for setting a first target engine speed in accordance with a command value commanded by the command means, and setting a second target engine speed which is lower than the first target engine speed based on the set first target engine speed, wherein when the pump displacement detected by the pump displacement detecting means decreases lower than a second predetermined pump displacement when the engine is controlled based on the first target engine speed, the target engine speed is changed from the first target engine speed to a fourth target engine speed which is lower than the first target engine speed and which is equal to or higher than the second target engine speed.

Further, the second specified invention of the application is mainly characterized in that it is prohibited to further change the fourth target engine speed for a predetermined time after the target engine speed is changed to the a fourth target engine speed.

Further, the second specified invention of the application is mainly characterized in that the relation between the fourth target engine speed and the second target engine speed are specified.

As an essential characteristic, a third specified invention provides an engine control device including at least one variable displacement hydraulic pump which is driven by an engine, at least one hydraulic actuator which is driven by discharge pressure oil from the variable displacement hydraulic pump, a control valve which controls the pressure oil discharged from the variable displacement hydraulic pump and supplies and discharges the pressure oil to and from the hydraulic actuator, and pump displacement detecting means for detecting a pump displacement of the variable displacement hydraulic pump, wherein the engine control device further includes command means for selecting and commanding one of command values that can be variably commanded, and setting means for setting a first target engine speed in accordance with a command value commanded by the command means, and setting a second target engine speed which is lower than the first target engine speed based on the set first target engine speed, wherein when the pump displacement detected by the pump displacement detecting means increases and exceeds a first predetermined pump displacement when the engine is controlled based on the second target engine speed, the target engine speed is changed from the second target engine speed to a third target engine speed which is higher than the second target engine speed and which is equal to or lower than the first target engine speed, and when the pump displacement detected by the pump displacement detecting means decreases lower than second predetermined pump displacement when the engine is controlled based on the third target engine speed, the target engine speed is changed from the third target engine speed to a fifth target engine speed which is lower than the third target engine speed and which is equal to or higher than the second target engine speed.

Further, the third specified invention of the application is mainly characterized in that it is prohibited to further change the third target engine speed for a predetermined time after the target engine speed is changed to the third target engine speed, and it is prohibited to further change the fifth target engine speed for a predetermined time after the target engine speed is changed to the fifth target engine speed.

Further, the third specified invention of the application is mainly characterized in that the relation between the third target engine speed and the first target engine speed, and/or the relation between the fourth target engine speed and the second target engine speed is specified.

A fourth specified invention of the application is mainly characterized in that a control method uses the first specified invention.

Further, the fourth specified invention of the application is mainly characterized in that it is prohibited to further change the third target engine speed for a predetermined time after the target engine speed is changed from the second target engine speed to the third target engine speed.

Further, the fourth specified invention of the application is mainly characterized in that a condition for changing the value of the first predetermined pump displacement is limited.

A fifth specified invention of the application is mainly characterized in that a control method uses the second specified invention.

Further, the fifth specified invention of the application is mainly characterized in that it is prohibited to further change the fourth target engine speed for a predetermined time after the target engine speed is changed from the first target engine speed to the fourth target engine speed.

Further, the fifth specified invention of the application is mainly characterized in that a condition for changing the value of the second predetermined pump displacement is limited.

A sixth specified invention of the application is mainly characterized in that a control method uses the third specified invention.

Further, the sixth specified invention of the application is mainly characterized in that it is prohibited to further change the third target engine speed for a predetermined time after the target engine speed is changed from the second target engine speed to the third target engine speed, and it is prohibited to further change the fifth target engine speed for a predetermined time after the target engine speed is changed from the third target engine speed to the fifth target engine speed.

Further, the sixth specified invention of the application is mainly characterized in that conditions for changing the values of the first and second predetermined pump displacements are limited.

Effect of the Invention

According to the present invention, the first target engine speed is set in accordance with a command value commanded by command means, and the second target engine speed can be set on the side of the low rotation field based on the set first target engine speed. When the engine is to be controlled in a state where the engine output torque is low, the engine can be controlled based on the second target engine speed. With this, the engine can be shifted to a field having excellent fuel economy and can be used without substantially changing the operation performance in the utility vehicle, and the amount of fuel consumed of the engine can be reduced.

If a pump displacement detected by pump displacement detecting means increases and exceeds a first predetermined pump displacement when the engine is controlled based on the second target engine speed, the target engine speed of the engine can be changed from the second target engine speed to the third target engine speed which is higher than the second target engine speed and is equal to or smaller than the first target engine speed to increase the operation speed of the operating machine, and the engine can be controlled.

With this, the engine can be rotationally driven in the optimal state in accordance with an operation status of the operating machine required by an operator, and a variable displacement hydraulic pump can absorb maximum output in the engine which is rotationally driven in its optimal state and can discharge pressure oil. Thus, in an operation requiring the maximum output of an engine such as a heavy excavation operation, the same operation performance as that of the conventional technique can be exhibited.

Engine speed which is previously fixed between the second target engine speed and the first target engine speed can be set as the third target engine speed, or the engine speed which is arbitrarily set in accordance with conditions between the second target engine speed and the first target engine speed can be set as the third target engine speed. The third target engine speed and the first target engine speed may match with each other as needed.

Engine speed which is arbitrarily set in accordance with conditions will be explained below. If the target engine speed of an engine is increased from the second target engine speed toward the first target engine speed, the pump displacement which has been equal to or greater than the first predetermined pump displacement in the second target engine speed is reduced lower than the first predetermined pump displacement as the target engine speed is increased.

If a differential pressure between the pump discharge pressure and the load pressure of the actuator satisfies a differential pressure (usually, called a load sensing differential pressure) which is set in a pump control device which controls the pump displacement of the hydraulic pump during the shifting operation of the target engine speed from the second target engine speed toward the first target engine speed, the engine speed at that time can be set as the third target engine speed.

In other words, it becomes unnecessary to further shift the target engine speed toward the first target engine speed. If the pump displacement detected by the pump displacement detecting means increases and exceeds the first predetermined pump displacement when the engine is controlled based on the third target engine speed, and the target engine speed is further shifted from the third target engine speed toward the first target engine speed.

If the differential pressure between the pump discharge pressure and the load pressure of the actuator satisfies the load sensing differential pressure during the shifting operation of the target engine speed from the third target engine speed toward the first target engine speed, the engine speed at that time is set as a new third target engine speed.

The third target engine speed can sequentially be set in this manner.

In a range of the engine output torque in which the maximum speed of the operating machine is required, it is possible to control the engine based on the third target engine speed. Further, the third target engine speed is a target engine speed capable of rotationally driving the engine in the optimal state suitable for operation state of the operating machine required by an operator, and the third target engine speed can be the first target engine speed at the maximum. Therefore, in the control of an engine based on the third target engine speed, the operating machine can be operated in the same operation state as that when the engine is controlled based on the first target engine speed set by the operator.

According to the present invention, it is possible to appropriately separately use the target engine speed into the first target engine speed, the second target engine speed and the third target engine speed in accordance with required engine output torque when controlling the engine to match the engine load and the engine output torque.

That is, while the engine output torque is low or while the pump displacement of the variable displacement hydraulic pump driven by an engine is small, the engine can be controlled using the second target engine speed. In a range of the engine output torque in which it is necessary to bring the operation speed of the operating machine in the high speed, the engine can be controlled based on the third target engine speed which can be increased to the first target engine speed at the maximum.

According to the present invention, if the pump displacement detected by the pump displacement detecting means decreases and becomes lower than the second predetermined pump displacement when the engine is controlled based on the first target engine speed, the target engine speed of the engine is changed from the first target engine speed to the fourth target engine speed which is lower than the first target engine speed and is equal to or higher than the second target engine speed.

With this, when a high engine output torque is unnecessary, the engine can be controlled in the fourth target engine speed (the engine speed can be reduced to the second target engine speed at the minimum as the fourth target engine speed) having excellent fuel economy, and the amount of fuel consumed of the engine can be reduced.

The pump displacement detected by the pump displacement detecting means increases and exceeds the first predetermined pump displacement when the engine is controlled based on the second target engine speed, the target engine speed of the engine can be changed from the second target engine speed to the third target engine speed, and if the pump displacement detected by the pump displacement detecting means decreases and becomes lower than the second predetermined pump displacement when the engine is controlled based on the third target engine speed, the target engine speed of the engine can be changed from the third target engine speed to a fifth target engine speed.

Further, as the third target engine speed, the fifth target engine speed can be increased to the first target engine speed at the maximum, and the fifth target engine speed can be lowered to the second target engine speed at the minimum.

The fourth target engine speed and the fifth target engine speed can be set as a engine speed previously fixed between the first target engine speed and the second target engine speed, and between the third target engine speed and the second target engine speed like the third target engine speed. Alternatively, the fourth target engine speed and the fifth target engine speed can arbitrarily be set in accordance with conditions between the first target engine speed and the second target engine speed, and between the third target engine speed and the second target engine speed. Alternatively, the fourth target engine speed and the fifth target engine speed may match with the second target engine speed as needed.

The engine speed which is set arbitrarily in accordance with conditions will be explained. If a differential pressure between the pump discharge pressure and the load pressures as the actuator exceeds the load sensing differential pressure during the shifting operation of the target engine speed from the fourth target engine speed and the fifth target engine speed to the second target engine speed, the engine speed at that time may be set as the third target engine speed.

If the pump displacement decreases and becomes lower than the second predetermined pump displacement when the engine is controlled in the once set fourth target engine speed or fifth target engine speed, the target engine speed can be shifted from the fourth target engine speed or fifth target engine speed to the second target engine speed. Alternatively, if the pump displacement exceeds the first predetermined pump displacement when the engine is controlled in the once set fourth target engine speed or fifth target engine speed, the target engine speed can be shifted from the fourth target engine speed or fifth target engine speed to the first target engine speed.

Accordingly, when a high engine output torque is unnecessary, since the second target engine speed or fifth target engine speed can be used as the target engine speed, the engine can be shifted to a field of excellent fuel economy and can be used, and the amount of fuel consumed of the engine can be reduced. In an operation requiring high engine output torque, e.g., in an operation requiring maximum output of an engine such as heavy excavation operation, the target engine speed can be increased to the third target engine speed or the first target engine speed and the same operation performance as that of the conventional technique can be exhibited.

Thus, although the structure is simple, the variable displacement hydraulic pump can absorb the maximum output of an engine and the amount of fuel consumed of the engine can be reduced. Further, a position where the target engine speed of an engine is changed from the second target engine speed to the third target engine speed, a position where the target engine speed is changed from the first target engine speed to the fourth target engine speed, and a position where the target engine speed is changed from the third target engine speed to the fifth target engine speed can previously be set as a pump displacement of a variable capacity pump. Therefore, it is easy to obtain these positions by experiment.

A pump displacement for specifying these positions can be obtained using a value obtained by actually measuring a pump displacement itself of a variable capacity pump, or using a relation equation indicating a pump displacement. To specify these positions, it is possible to use a state where a discharging amount from a variable displacement hydraulic pump becomes the maximum discharge amount that can be discharged from the variable displacement hydraulic pump without using a value of the pump displacement, a value of the engine output torque or a value of the engine speed at that time, a relation of a differential pressure between a pump discharge pressure of a variable displacement hydraulic pump and a load pressure of an actuator with respect to a differential pressure (usually called a load sensing differential pressure) which is set in a pump control device which control a swash plate angle of the variable displacement hydraulic pump, and these parameter values as values corresponding to the value of the pump displacement, instead of directly using the pump displacement.

Therefore, the above-described factors, parameter values are included ad the pump displacement used for specifying the above-described positions in the present invention.

Based on the first target engine speed to the fifth target engine speed, in the T-N diagram of the engine (torque diagram including the engine output torque axis and the engine speed axis), it is possible to set corresponding high-speed control fields, and it is possible to perform the control in the high-speed control field. Further, in the present invention, the control in the high-speed control field is also included in each control based on the first target engine speed to fifth target engine speed.

EXPLANATION OF REFERENCE NUMERALS

Figure 1:
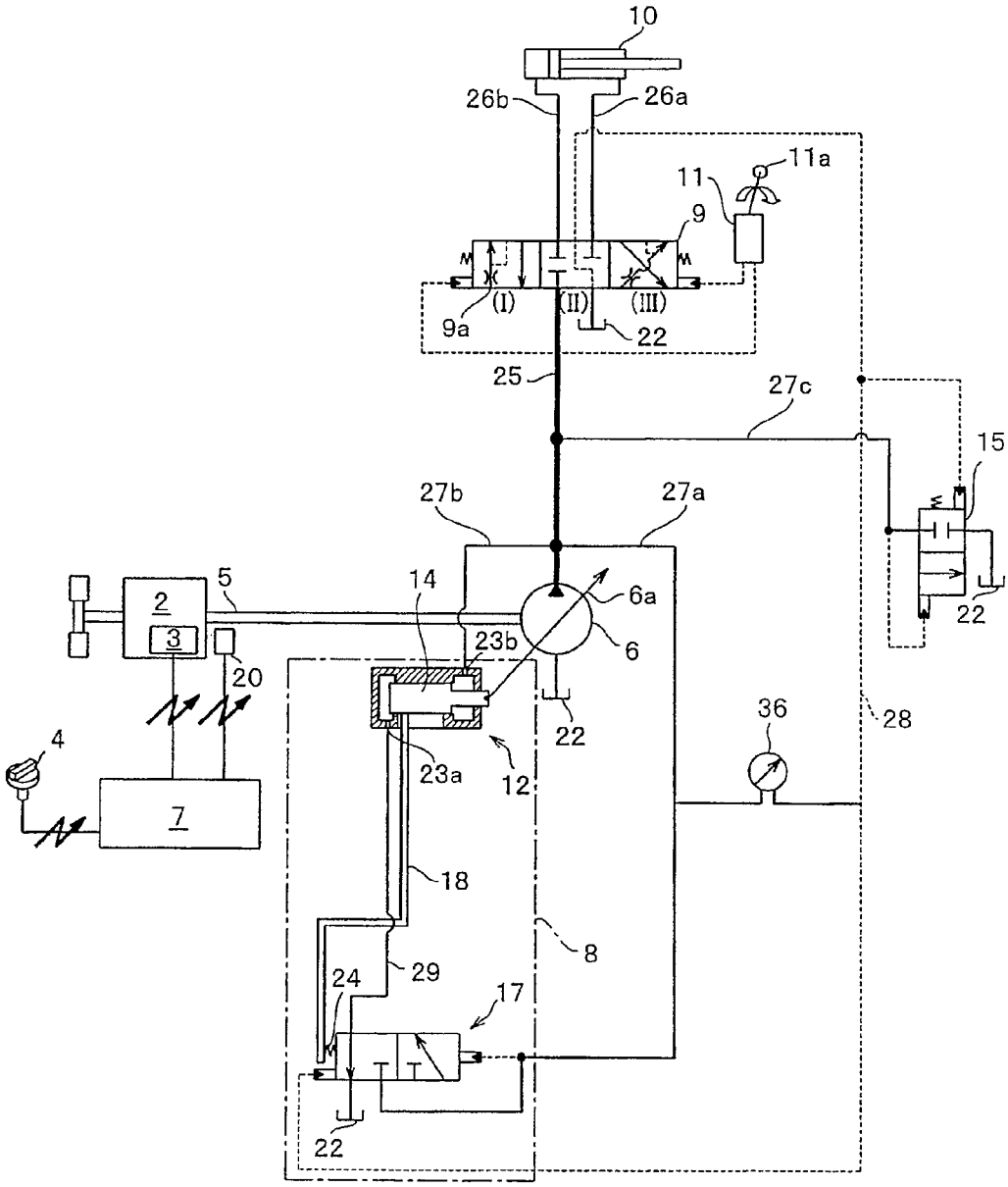
FIG. 1 is a hydraulic circuit diagram according to an embodiment of the present invention (embodiment)

2: engine
4: fuel dial
6: variable displacement hydraulic pump
7: controller
8: pump control device
9: control valve
11: operation lever device
12: servo cylinder
17: LS valve
50: variable displacement hydraulic pump
53: third control valve
54: center bypass circuit
55: throttle
57: servo actuator
58: servo guide valve
59: negative control valve
71: first pilot valve
72: second pilot valve
73: third pilot valve
75: controller
76: pump control device
F1 to F4: high-speed control field
Fa to Fc: high-speed control field
A: first set position
B: second set position
Nh: rated engine speed
K1: rated point
R: maximum torque line
M: equal fuel economy curve

BEST MODE FOR CARRYING OUT THE INVENTION

A preferred embodiment of the present invention will be explained concretely based on the accompanying drawings. An engine control device and an engine control method of the present invention can suitably be applied as a control device and a control method for controlling a diesel engine provided in a utility vehicle such as a hydraulic shovel, a bulldozer and a wheel loader.

The engine control device and the engine control method of the present invention can employ a shape and a structure capable of solving the problem of the present invention in addition to a shape and a structure which will be explained below. Therefore, the present invention is not limited to the embodiment which will be explained below, and the invention can variously be modified.

Embodiments

FIG. 1 is a hydraulic circuit diagram of an engine control device and an engine control method according to an embodiment of the invention. An engine 2 is a diesel engine, and an output torque of the engine is controlled by adjusting an amount of fuel injected into a cylinder of the engine 2. The fuel can be adjusted by a conventionally known fuel injector 3.

A variable displacement hydraulic pump 6 (hydraulic pump 6, hereinafter) is connected to an output shaft 5 of the engine 2. The hydraulic pump 6 is driven when the output shaft 5 rotates. An inclination angle of a swash plate 6*a* of the hydraulic pump 6 is controlled by a pump control device 8, and a pump displacement D (cc/rev) of the hydraulic pump 6 is varied by changing an inclination angle of the swash plate 6*a*.

The pump control device 8 includes a servo cylinder 12 which controls the inclination angle of the swash plate 6*a*, and a LS valve (load sensing valve) 17 controlled in accordance with a differential pressure between a pump pressure and a load pressure of an actuator 10. The servo cylinder 12 includes a servo piston 14 acting on the swash plate 6*a*. A discharge pressure from the hydraulic pump 6 can be taken out by oil passages 27*a* and 27*b*. The LS valve 17 is operated in accordance with a differential pressure between the discharge pressure taken out by the oil passage 27*a* and a load pressure of the actuator 10 taken out by a pilot oil passage 28, and the servo piston 14 is controlled by the operation of the LS valve 17.

The inclination angle of the swash plate 6*a* of the hydraulic pump 6 is controlled by the control of the servo piston 14. A control valve 9 is controlled in accordance with an operation amount of an operation lever 11*a*. Therefore, a flow rate to be supplied to the actuator 10 is controlled. The pump control device 8 may be a known load sensing control device.

Pressure oil discharged from the hydraulic pump 6 is supplied to the control valve 9 through a discharge oil passage 25. The control valve 9 is constituted as a switch valve capable of switching between five ports and three positions, and can operate the actuator 10 by selectively supplying pressure oil which is output from the control valve 9 to oil passages 26*a* and 26*b*.

The actuator is not limited to the hydraulic cylinder type actuator, and may be a hydraulic motor or a rotary type actuator. Although only one set of the control valve 9 and the actuator 10 is shown as an example, a plurality of sets of the control valve 9 and the actuator 10 may be constituted, or one control valve may operate a plurality of actuators.

If the actuator is explained based on a hydraulic shovel as the utility vehicle, a boom hydraulic cylinder, an arm hydraulic cylinder, a bucket hydraulic cylinder, a left running hydraulic motor, a right running hydraulic motor and a turning motor are used as the actuators. Of the actuators, FIG. 1 shows the boom hydraulic cylinder as a representative thereof.

When the operation lever 11*a* is operated from its neutral position, a pilot pressure is output from an operation lever device 11 in accordance with an operation direction and an operation amount of the operation lever 11*a*. The output pilot pressure is applied to either one of left and right pilot ports of the control valve 9. With this, the control valve 9 is switched from a position (II) which is the neutral position to a position (I) or a position (III) on left and right.

If the control valve 9 is switched from the position (II) to the position (I), a discharge pressure oil from the hydraulic pump 6 can be supplied from the oil passage 26*b* toward a bottom side of the actuator 10, and a piston of the actuator 10 can be extended. At that time, a pressure oil on a head side of the actuator 10 is discharged to a tank 22 from the oil passage 26*a* through the control valve 9.

Similarly, if the control valve 9 is switched to the position (III), the discharge pressure oil from the hydraulic pump 6 can be supplied to the head side of the actuator 10 from the oil passage 26*a*, and the piston of the actuator 10 can be shortened. At that time, the pressure oil on the bottom side of the actuator 10 is discharged to the tank 22 from the oil passage 26*b* through the control valve 9.

An oil passage 27*c* is branched from an intermediate portion of the discharge oil passage 25, and an unload valve 15 is disposed in the oil passage 27*c*. The unload valve 15 is connected to the tank 22, and the oil passage 27*c* can be switched between a position where the oil passage 27*c* is blocked and a position where the oil passage 27*c* is brought into communication. The hydraulic pressure in the oil passage 27*c* functions as a pushing force which switches the unload valve 15 into the communication position.

A pilot pressure of the pilot oil passage 28 which takes out a load pressure of the actuator 10 and a spring force of a spring which gives a constant differential pressure function as a pushing force which switches the unload valve 15 into the block position. The unload valve 15 is controlled by the differential pressure between the pilot pressure of the pilot oil passage 28 and the spring force of the spring and the hydraulic pressure in the oil passage 27*c*.

If an operator operates a fuel dial 4 as the command means and selects one of command values which can variably be commanded, a target engine speed corresponding to the selected command value can be set. A high-speed control field which matches the engine load and the engine output torque with each other can be set in accordance with the target engine speed which was set in this manner.

Figure 2:
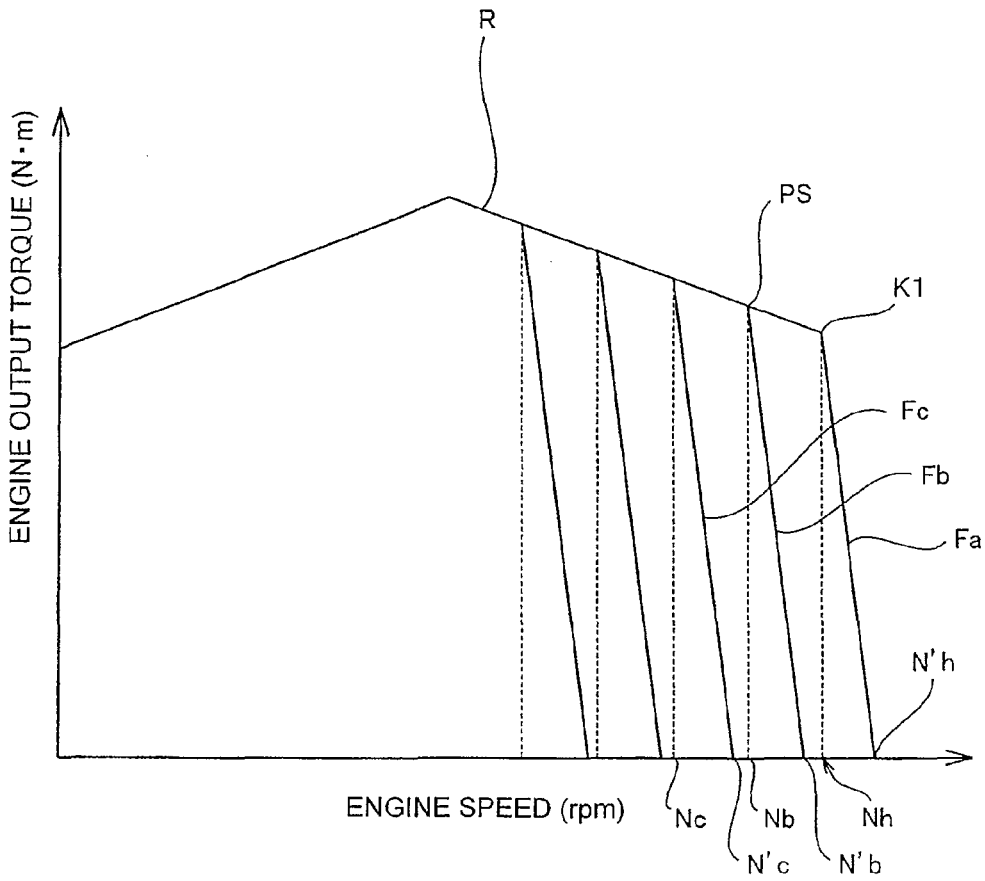
FIG. 2 is a torque diagram of an engine (embodiment)

That is, as shown in FIG. 2, if a target engine speed Nb (N'b) which is the first target engine speed is set in accordance with the operation of the fuel dial 4, a high-speed control field Fb suitable for the target engine speed Nb (N' b) is selected. At that time, the target engine speed of the engine is engine speed Nb (N'b).

The target engine speed Nb (N' b) of the engine is determined as a point where the engine output torque and a total value of a friction torque of the engine at the time of no load and a loss torque of a hydraulic system match with each other when the target engine speed is controlled to the engine speed Nb. In the actual engine control, a line connecting the target engine speed N'b and the matching point Ps with each other is set as the high-speed control field Fb.

The following explanation is based on an example in which the target engine speed N'b is located at a higher rotation side than the target engine speed Nb, but the target engine speed N'b and the target engine speed Nb can match each other or the target engine speed N'b can be located at a lower rotation side than the target engine speed Nb. In the following explanation, the engine speed N'c having dash is described like the target engine speed Nc (N'c), but the engine speed N'c having the dash is one described above.

If an operator operates the fuel dial 4 and sets a low target engine speed Nc (N'c) which is different from the initial selected target engine speed Nb (N'b), a high-speed control field Fc in a low rotation field side is set as the high-speed control field. The target engine speed Nc (N'c) which is set at that time is the first target engine speed.

By setting the fuel dial 4 in this manner, one high-speed control field can be set in correspondence with the target engine speed which can be selected by the fuel dial 4. That is, by selecting the fuel dial 4, any one of high-speed control fields can be set from a high-speed control field Fa passing a rated point K1 and a plurality of high-speed control fields Fb, Fc, . . . on the low rotation side from the high-speed control field Fa as shown in FIG. 2, or any high-speed control field located at an intermediate portion of the high-speed control fields can be set.

Figure 3:
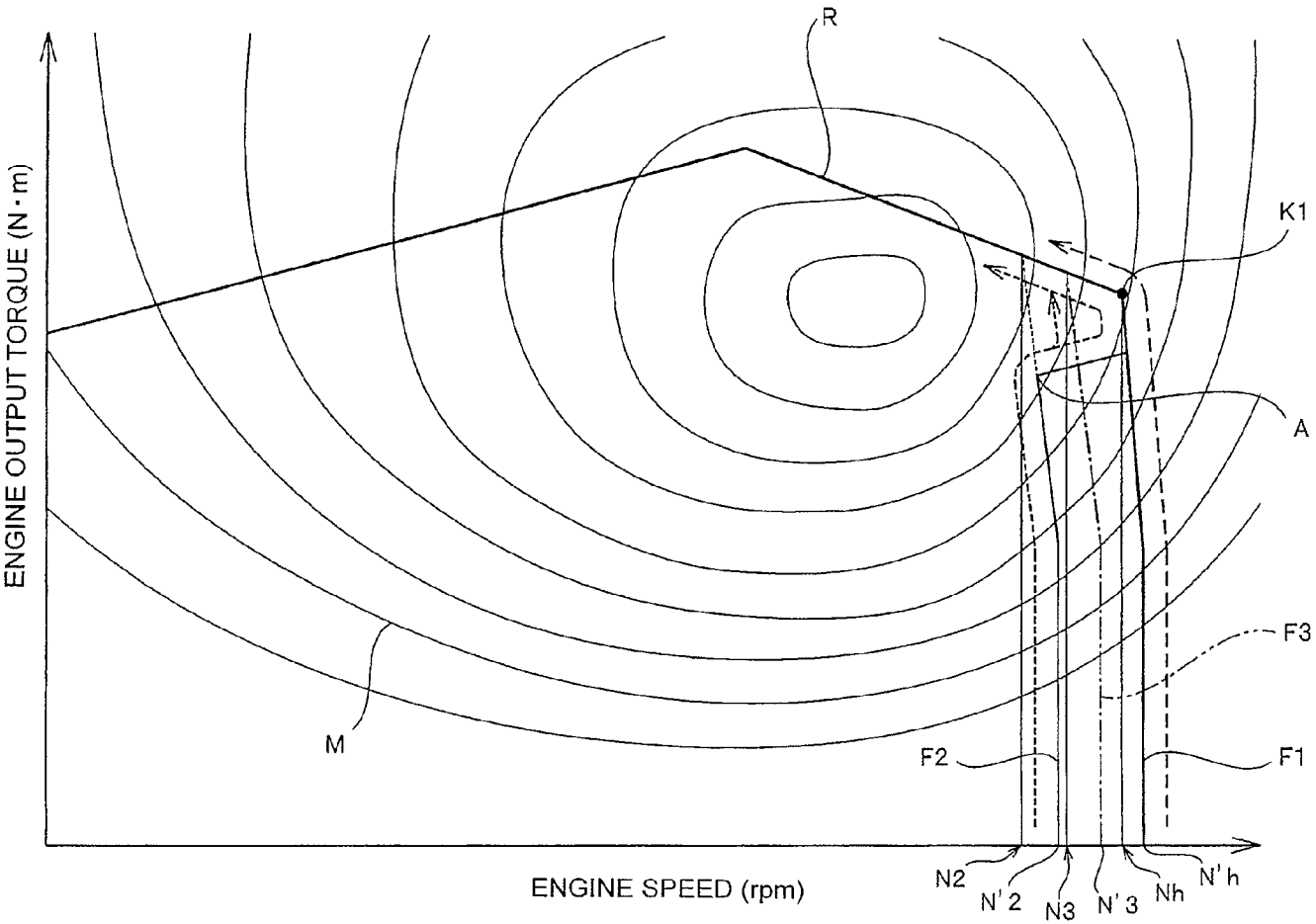
FIG. 3 is a torque diagram when an engine output torque is increased (embodiment)

In the torque diagram in FIG. 3, a field defined by a maximum torque line R shows performance that the engine 2 can obtain. The output (horsepower) of the engine 2 become maximum at the rated point K1 on the maximum torque line R. Here, M represents a fuel economy curve of the engine 2 or the like, and a center side of the fuel economy curve is a fuel economy minimum field.

An example in which target engine speed Nh (N'h) which is the maximum target engine speed of the engine is set in correspondence with a command value of the fuel dial 4 and a high-speed control field F1 passing the rated point K1 is set in correspondence with the target engine speed Nh (N'h) will be explained below. That is, a case in which the target engine speed Nh (N'h) is set as the first target engine speed will be explained. At that time, a control flow for moving on a high-speed control field F1 while matching the engine load and the engine output torque will be explained using a control flow in FIG. 5 and a block diagram of a controller in FIG. 6 mainly with reference to FIGS. 1, 3 and 4.

A case in which a high-speed control field F1 passing through the maximum target engine speed Nh (N'g), i.e., the rated point K1 as the engine speed is set as the first target engine speed in correspondence with a command value of the fuel dial 4 will be explained, but the present invention is not limited to a case where the high-speed control field F1 passing through the rated point K1 is set. For example, even if any high-speed control field is set from a plurality of high-speed control fields Fb, Fc, in FIG. 2 or in an intermediate portion of the plurality of high-speed control fields Fb, Fc, . . . in accordance with the set first target engine speed, the present invention can suitably be applied to each of set high-speed control fields.

Figure 4:
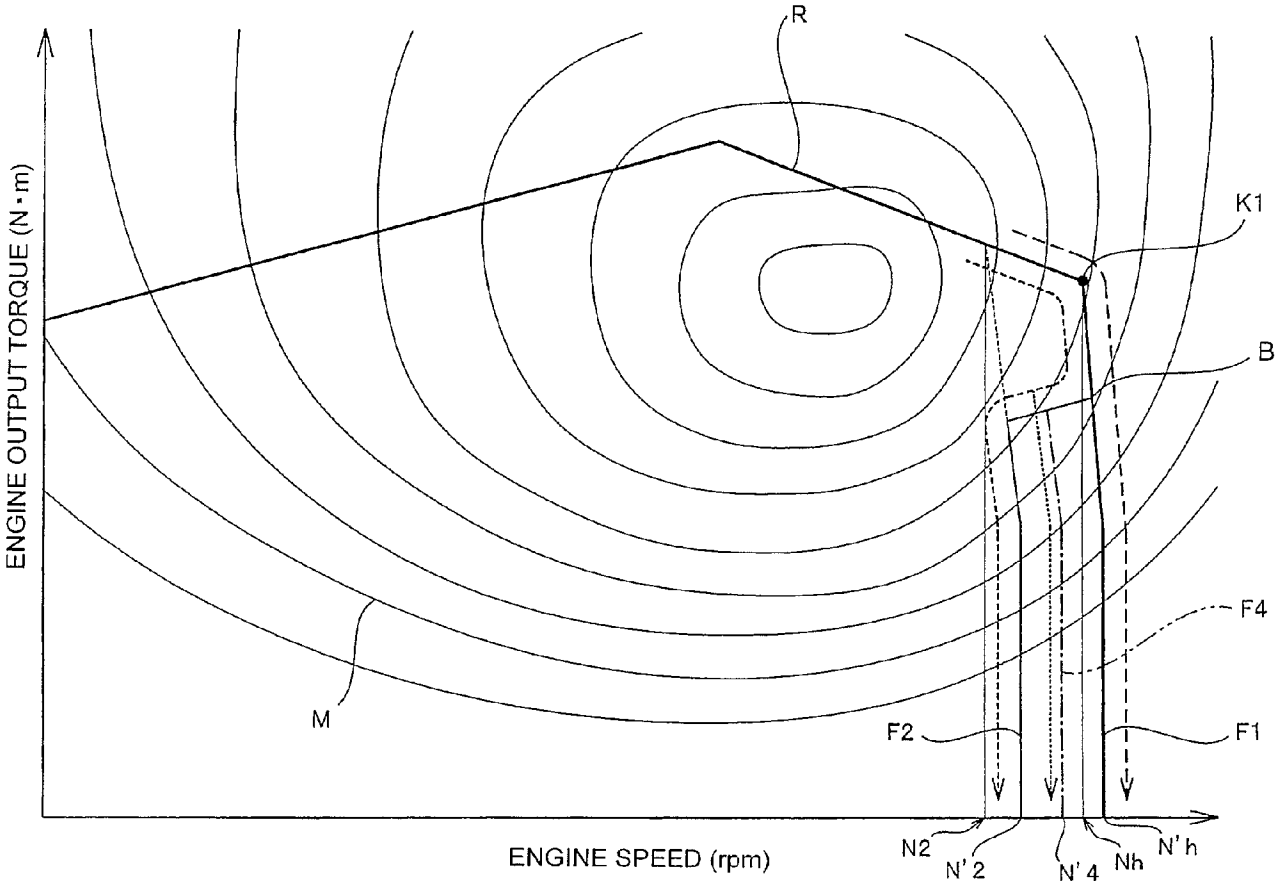
FIG. 4 is a torque diagram when the engine output torque is reduced (embodiment)
Figure 5:
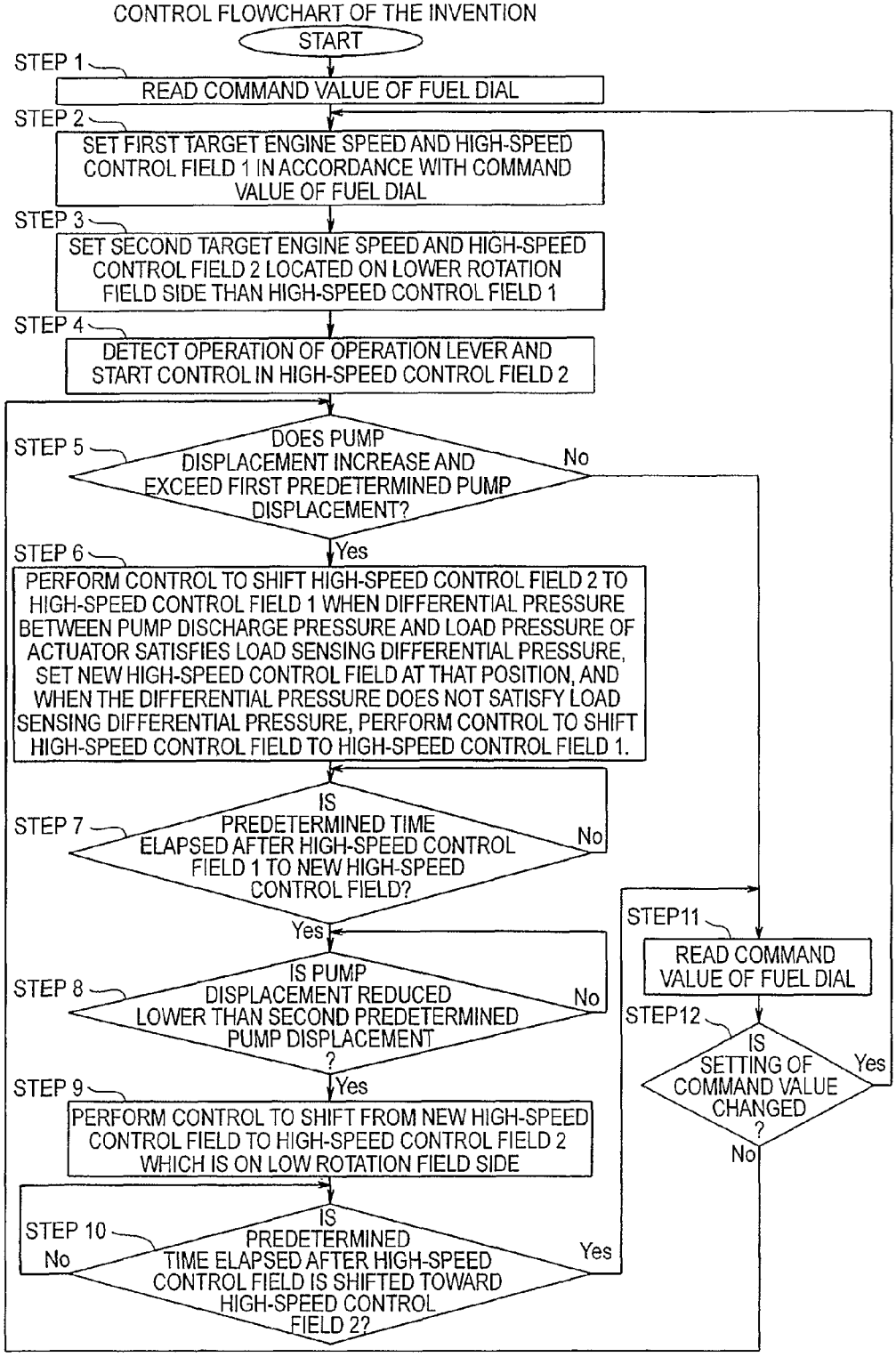
FIG. 5 is a control flowchart according to the invention (embodiment)
Figure 6:
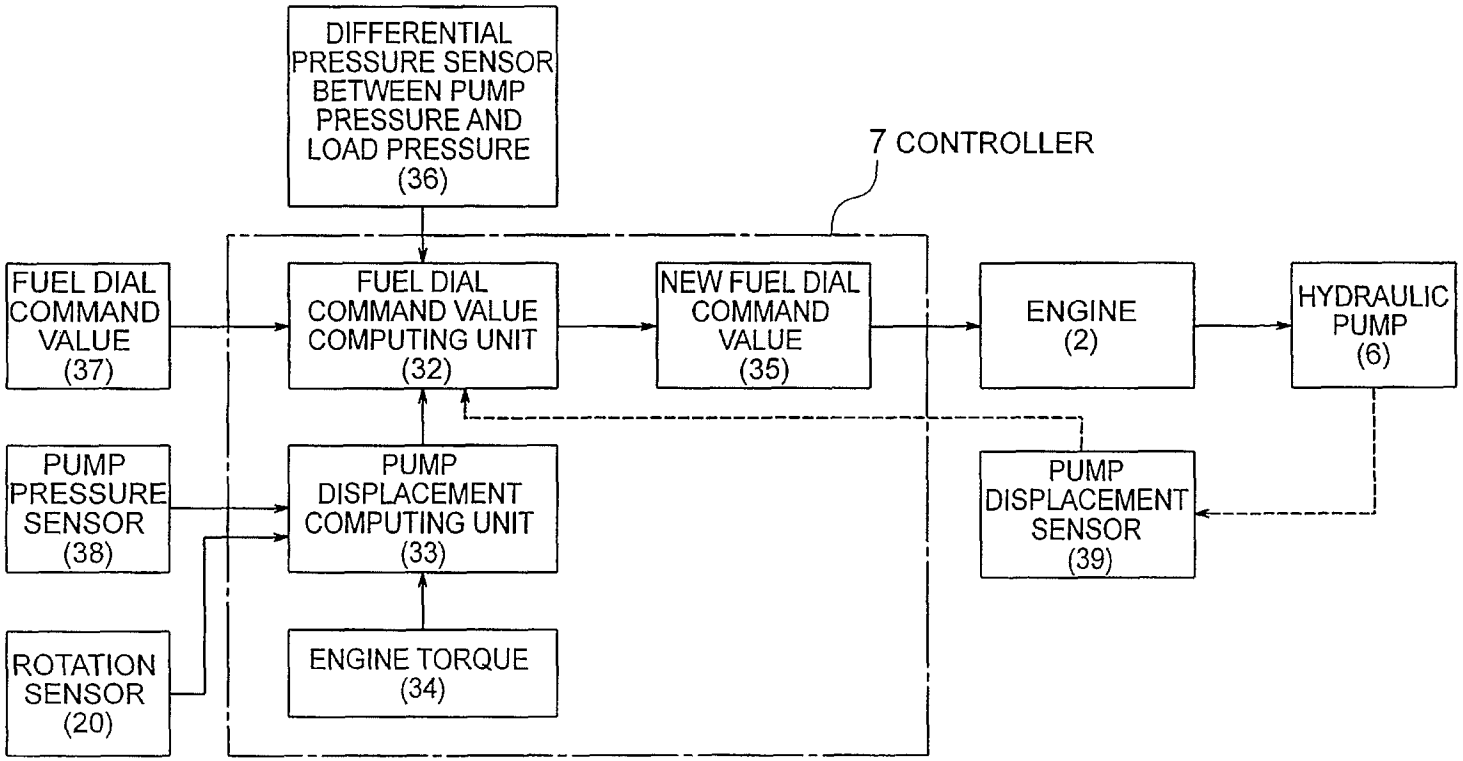
FIG. 6 is a block diagram of a controller (embodiment)

FIG. 3 shows a state where the engine output torque is increasing. FIG. 4 shows a state where the engine output torque is decreasing. FIG. 5 shows a control flow. In FIG. 6, a portion surrounded by a phantom line shows the controller 7.

In step 1 in FIG. 5, the controller 7 reads a command value of the fuel dial 4. If the controller 7 reads a command value of the fuel dial 4, the procedure is shifted to step 2.

In step 2, the controller 7 sets target engine speed Nh (N'h) of the engine 2 as the first target engine speed in accordance with the read command value of the fuel dial 4, and sets a high-speed control field F1 based on the set target engine speed Nh (N'h).

In this explanation, the target engine speed Nh (N'h) of the engine 2 is first set in accordance with the read command value of the fuel dial 4, but the high-speed control field F1 may be set first, and the target engine speed Nh (N'h) may be set in correspondence with the set high-speed control field F1. Alternatively, the target engine speed Nh (N' h) and the high-speed control field F1 may be set simultaneously in accordance with the read command value of the fuel dial 4.

As shown in FIG. 3, if the target engine speed Nh (N'h) as the first target engine speed and the high-speed control field F1 are set, the procedure is shifted to step 3.

In FIG. 3, a line connecting the rated point K1 and a high idle point N' h of the maximum target engine speed Nh is indicated as the high-speed control field F1. This high idle point N'h can be determined as a point where the engine output torque and a total value of a friction torque of the engine at the time of no load and a loss torque of a hydraulic system match with each other when the target engine speed is controlled to the maximum target engine speed Nh as already explained in the description of the high-speed control field Fb using FIG. 2.

In step 3, the controller 7 determines first target engine speed Nh (N'h), target engine speed N2 (N'2) as a second target engine speed located on a low rotation field side which is preset in correspondence with the high-speed control field F1, and high-speed control field F2 corresponding to the target engine speed N2 (N'2) using setting means.

The high-speed control field F2 can preset as a high-speed control field where an operating speed is not lowered almost at all by a load sensing control as compared with a case where the speed is controlled by the high-speed control field F1 when the operation lever 11*a* of a hydraulic shovel is operated for example.

That is, target engine speed N2 suitable for the high-speed control field F2 can be set such that it is reduced by 10% as compared with the target engine speed Nh corresponding to the high-speed control field F1. Although the target engine speed is reduced by 10% in this explanation, this numeric value is only an example, and the present invention is not limited to this numeric value.

The high-speed control field F2 located at a lower rotation side than the high-speed control field F1 can be set as a high-speed control field corresponding to the high-speed control field F1 in correspondence with each high-speed control field F1 which can be set by the fuel dial 4.

The high-speed control field F2 is determined by the controller 7 and the procedure is shifted to step 4.

In step 4, if the operation lever 11*a* is operated, the controller 7 controls the fuel injector 3 such that the controller 7 matches the engine load and the engine output torque with each other on the high-speed control field F2 as shown with fine dotted line in FIG. 3.

If the operator operates the operation lever 11*a* and stars control to increase the operating machine speed of the hydraulic shovel, the procedure is shifted to step 5.

In step 5, it is determined whether a discharge amount from the hydraulic pump 6 becomes the maximum discharge amount that the hydraulic pump 6 can discharge in the high-speed control field F2.

Here, a case where the operator deeply operates the operation lever 11*a* to increase the operating machine speed of the hydraulic shovel will be explained. If the operation lever 11*a* is deeply operated and the control valve 9 is switched to the position (I), an opening area 9*a* of the control valve 9 at the position (I) is increased, and a differential pressure between the pump discharge pressure in the oil passage 25 and the load pressure in the pilot oil passage 28 is reduced. At that time, the pump control device 8 constituted as the load sensing control device is operated in a direction increasing the pump displacement of the hydraulic pump 6.

The first predetermined pump displacement can be set using the maximum pump displacement value in the hydraulic pump 6 or may be set as a pump displacement which is equal to or lower than the maximum pump displacement. A case in which the maximum pump displacement is set as the first predetermined pump displacement will be explained below. If the pump displacement of the hydraulic pump 6 is increased to the maximum pump displacement, the discharge amount from the hydraulic pump 6 in the high-speed control field F2 becomes the maximum discharge amount that the hydraulic pump 6 can discharge in the high-speed control field F2.

A state where the discharge amount from the hydraulic pump 6 becomes the maximum can be detected using various parameter values which will be explained next. The pump displacement detecting means can be constituted as detecting means capable of detecting various parameter values which will be explained below.

A case where a value of the engine output torque is used as a parameter value capable of detecting a state where the discharge amount from the hydraulic pump 6 becomes maximum will be explained first.

The controller 7 can specify a position on the high-speed control field F2 corresponding to the engine speed from the engine speed detected by the rotation sensor 20 based on the torque diagram stored in the controller 7: A value of the engine output torque at that time can be obtained based on the specified position. By using the value of the engine output torque as a parameter value in this manner, a state where the discharge amount from the hydraulic pump 6 becomes the maximum discharge amount that the hydraulic pump 6 can discharge can be detected in the high-speed control field F2.

When the pump displacement of the hydraulic pump 6 is used as the parameter value, a relation between a discharge pressure P of the hydraulic pump 6, the discharge capacity D (pump displacement D) and the engine output torque T can be expressed as $T=P\cdot D/200\pi$. The pump displacement of the hydraulic pump 6 can be obtained from $D=200\pi\cdot T/P$ using this relation equation. A command value of the engine output torque held in the controller can be used as the engine output torque T.

Alternatively, a swash plate angle sensor (not shown) may be attached to the hydraulic pump 6, and the pump displacement of the hydraulic pump 6 may be obtained by directly measuring the pump displacement of the hydraulic pump 6. A state where the discharge amount from the hydraulic pump 6 in the high-speed control field F2 becomes the maximum discharge amount that the hydraulic pump 6 can discharge can be detected by the pump displacement of the hydraulic pump 6 obtained in this manner.

By using the value obtained while grasping the pump displacement of the hydraulic pump 6 and engine output torque, it is possible to detect the state where the discharge amount becomes the maximum that the hydraulic pump 6 can discharge in the high-speed control field F2.

When an operator further deeply operates the operation lever 11*a* to increase the operating machine speed from the state where the discharge amount becomes maximum that the hydraulic pump 6 can discharge in the high-speed control field F2, control for shifting from the high-speed control field F2 to the high-speed control field F1 is carried out, and the position on the high-speed control field F2 at that time can be determined as a first set position A (i.e., first predetermined pump displacement).

That is, if an operator further deeply operates the operation lever 11*a* when the engine speed becomes equal to a value which specifies the first set position A in the high-speed control field F2, or when a value obtained by grasping the pump displacement of the hydraulic pump 6 or the engine output torque becomes equal to a value which specifies the first set position A, control for shifting from the high-speed control field F2 to the high-speed control field F1 is carried out for increasing the operating machine speed.

If the first set position A is detected, the procedure is shifted to step 6. When the first set position A is not detected, the procedure is shifted to step 11.

A position of the first set position A can be changed in accordance with a rate of change of the engine output torque T or a ratio of change of the pump displacement of the hydraulic pump 6. Since the relation between the discharge pressure P of the hydraulic pump 6, the discharge capacity D (pump displacement D) and the engine output torque T can be expressed as $T=P\cdot D/200\pi$ as described above, the position of the first set position A can be changed in accordance with the rate of change of the discharge pressure P of the hydraulic pump 6.

That is, when the rates of change, i.e., the increasing degrees are high, the position of the first set position A is set to a side where the engine output torque is low, and the position can be shifted to the high-speed control field F1 early.

In step 6, if an operator further deeply operates the operation lever 11*a* when the engine speed becomes equal to a value which specifies the first set position A in the high-speed control field F2 or when a value obtained by grasping the pump displacement of the hydraulic pump 6 or the engine output torque becomes equal to a value which specifies the first set position A, control is performed to shift the high-speed control field F2 toward the high-speed control field F1 to increase the operating machine speed.

In this case, if a differential pressure between the pump discharge pressure and the load pressure of the actuator 10 satisfies a differential pressure which is set in the pump control device 8 (usually called a load sensing differential pressure, and this is called the load sensing differential pressure, hereinafter) during the shifting operation from the high-speed control field F2 toward the high-speed control field F1, the high-speed control field passing that position is set as a high-speed control field 3 as the high-speed control field.

That is, it becomes unnecessary to shift toward the high-speed control field F1 any more. In this case, control at the high-speed control field F3 shown with the phantom line in FIG. 3 is carried out.

If the differential pressure between the discharge pressure from the hydraulic pump 6 and the load pressure of the actuator 10 at the engine speed during the shifting operation from the high-speed control field F2 toward the high-speed control field F1 does not satisfy the load sensing differential pressure, the high-speed control field is controlled for shifting the same to the high-speed control field F1 located on the high rotation field. Control for increasing the engine speed to the maximum target engine speed Nh is performed.

Control of the controller 7 carried out at that time will be explained using FIG. 6. In FIG. 6, a command value 37 of the fuel dial 4 is input to a fuel dial command value computing unit 32 in the controller 7, and a pump displacement which is output from a pump displacement computing unit 33 which calculates a pump displacement of the hydraulic pump 6 is input. A detection signal from a differential pressure sensor 36 which detects a differential pressure between the pump pressure and the load pressure of the actuator 10, or a detection signal from the pump displacement sensor 39 (both not shown in FIG. 1) can also be input to the fuel dial command value computing unit 32.

In FIG. 6, the detection signal which is output from the differential pressure sensor 36 to the fuel dial command value computing unit 32, the detection signal from the hydraulic pump 6 to the pump displacement sensor 39, and the detection signal which is output from the pump displacement sensor 39 to the fuel dial command value computing unit 32 are shown with broken lines. These detecting means are shown with broken line to show that the detecting means can be used as alternative means of the pump displacement computing unit 33 as described below. The differential pressure sensor 36 and the pump displacement sensor 39 can be used independently.

An engine torque 34 obtained from a torque diagram of the engine is input to the pump displacement computing unit 33 using the pump pressure of the hydraulic pump 6 detected by the pump pressure sensor 38 and the engine speed in the high-speed control field detected by the rotation sensor 20. In the pump displacement computing unit 33, pump displacement is calculated from the input values, and results of the calculations are output to the fuel dial command value computing unit 32. The pump pressure sensor 38 can be disposed such that it can detect a pump pressure in the discharge oil passage 25 shown in FIG. 1.

A detection signal from the pump displacement sensor 39 can be input to the fuel dial command value computing unit 32 instead of using a pump displacement which is output from the pump displacement computing unit 33. The pump displacement sensor 39 can be constituted as a sensor which detects a swash plate angle of the hydraulic pump 6.

If the fuel dial command value computing unit 32 determines that the following conditions are satisfied, the fuel dial command value computing unit 32 sets a new fuel dial command value 35 for performing control to shift the high-speed control field F2 toward the high-speed control field F1. The set new fuel dial command value 35 is commanded to the fuel injector 3 of the engine 2.

The conditions for performing the control to shift from the high-speed control field F2 toward the high-speed control field F1 are a condition that the fact that pump displacement of the hydraulic pump 6 is increased to the maximum pump displacement state by pump displacement which is output from the pump displacement computing unit 33 or pump displacement which is detected from the pump displacement sensor 39 is detected, or a condition that the fact that a differential pressure between the pump discharge pressure and the load pressure of the actuator 10 becomes lower than a load sensing differential pressure which is set by the pump control device 8 is detected by a detection signal from the differential pressure sensor 36.

For example, if the fact that the differential pressure between the pump discharge pressure and the load pressure of the actuator 10 satisfies the load sensing differential pressure which is set by the pump control device 8 is detected by a detection signal from the differential pressure sensor 36 while control to shift from the high-speed control field F2 toward the high-speed control field F1 is carried out, a value of the fuel dial command value becomes the new fuel dial command value 35, and a high-speed control field passing through that position is set as a new high-speed control field F3.

Returning to the control flow in FIG. 5, explanation will be continued. In the control for shifting from the high-speed control field F2 toward the high-speed control field F1, it is possible to carry out control for shifting directly to the high-speed control field F1 without shifting from the high-speed control field F2 to the high-speed control field F3. In such a case, since the engine speed in the high-speed control field F1 becomes higher than the engine speed in the high-speed control field 3, the discharge amount of pump from the hydraulic pump 6 is increased correspondingly.

With this, the load sensing differential pressure becomes higher than a set value which is set by the pump control device 8. Therefore, the pump displacement of the hydraulic pump 6 becomes smaller than that of the high-speed control field F3 by the load sensing function in the pump control device 8, and a predetermined pump discharge amount is discharged from the hydraulic pump 6. Similarly, when the high-speed control field F2 is shifted to the high-speed control field F3 also, the pump displacement of the hydraulic pump 6 is reduced from the maximum pump displacement to a pump displacement smaller than the maximum pump displacement, and a predetermined pump discharge amount is discharged from the hydraulic pump 6.

If a load of the actuator 10 is further increased after the speed control field is shifted to the high-speed control field F3 or the high-speed control field F1, the engine output torque is increased. If the load of the actuator 10 is further increased in the high-speed control field F1, the pump displacement of the hydraulic pump 6 is increased to the maximum pump displacement, and the engine output torque is increased to the rated torque point K1. If the load of the actuator 10 is further increased in the high-speed control field F3, the pump displacement of the hydraulic pump 6 is increased to the maximum pump displacement, and the engine output torque is increased to the maximum torque line R along the high-speed control field F3.

If the load is further increased in the high-speed control field F3 or the high-speed control field F1, it matches with the engine output torque on the maximum torque line R. Since it can change in this manner, the operating machine can absorb the maximum horsepower as in the conventional technique.

That is, when shifted from the high-speed control field F2 to the high-speed control field F1, control for increasing toward the maximum torque line R along the fine dotted line in FIG. 3 is carried out. Control for increasing directly toward the maximum torque line R branching off from an intermediate portion of the fine dotted line in FIG. 3 showing the control state when shifting from the high-speed control field F2 to the high-speed control field F1 shows control after the speed control field is shifted from the high-speed control field F2 to the high-speed control field F3.

The control shown with the phantom line shows control in the high-speed control field F3, and a state shown with thick dotted line shows a state where control is conventionally carried out while keeping the high-speed control field F1 state.

The maximum pump displacement is set as the first predetermined pump displacement in the above description but alternatively, a value of a pump displacement which is equal to or less than the maximum pump displacement can be set as the first predetermined pump displacement. The first predetermined pump displacement at that time can previously be set by experiment.

For example, the pump displacement of the hydraulic pump 6 reaches 90% of the maximum pump displacement on the high-speed control field F2 and when there is an increasing tendency, the point at which the pump displacement reaches 90% can be set as the first set position A. In this case, it is estimated that the pump displacement of the hydraulic pump 6 reaches 100% immediately after the pump displacement reaches 90%, and control for shifting from the high-speed control field F2 to a high rotation side high-speed control field can be carried out.

It is possible to know the percentage (%) of pump displacement of the hydraulic pump 6 based on the maximum pump displacement when shifting from the high-speed control field F2 toward the high rotation field side, by experimentally knowing which % an increasing rate of the operating machine speed obtained by increasing the pump displacement of the hydraulic pump 6 and an increasing rate of the operating machine speed obtained by increasing the engine speed are smoothly connected to each other.

Another means for determining the first set position A, the following means exists. That is, when a differential pressure between the discharge pressure from the hydraulic pump 6 and the load pressure of the actuator 10 becomes lower than the load sensing differential pressure, it is determined that the discharge flow rate from the hydraulic pump 6 is insufficient, and time at which the differential pressure between the discharge pressure of the hydraulic pump 6 and the load pressure of the actuator 10 is reduced from a state where the differential pressure and the load sensing differential pressure match with each other can be used as means for determining the first set position A.

At that time, the pump discharge flow rate is insufficient on the high-speed control field F2, and in other words, it can be determined that the hydraulic pump 6 is brought into the maximum pump displacement state. Therefore, control for shifting the high-speed control field F2 toward the high rotation field is carried out so that the engine can rotate in the high rotation field.

In the above embodiment, the hydraulic circuit includes the load sensing control device. Alternatively, the pump displacement of the hydraulic pump 9 may be obtained from the torque diagram of the actually measured value of the engine engine speed and the engine, and in the method for obtaining the pump displacement directly by the pump swash plate angle sensor, the hydraulic circuit shown in FIG. 7 may be of an open sensor type.

Figure 7:
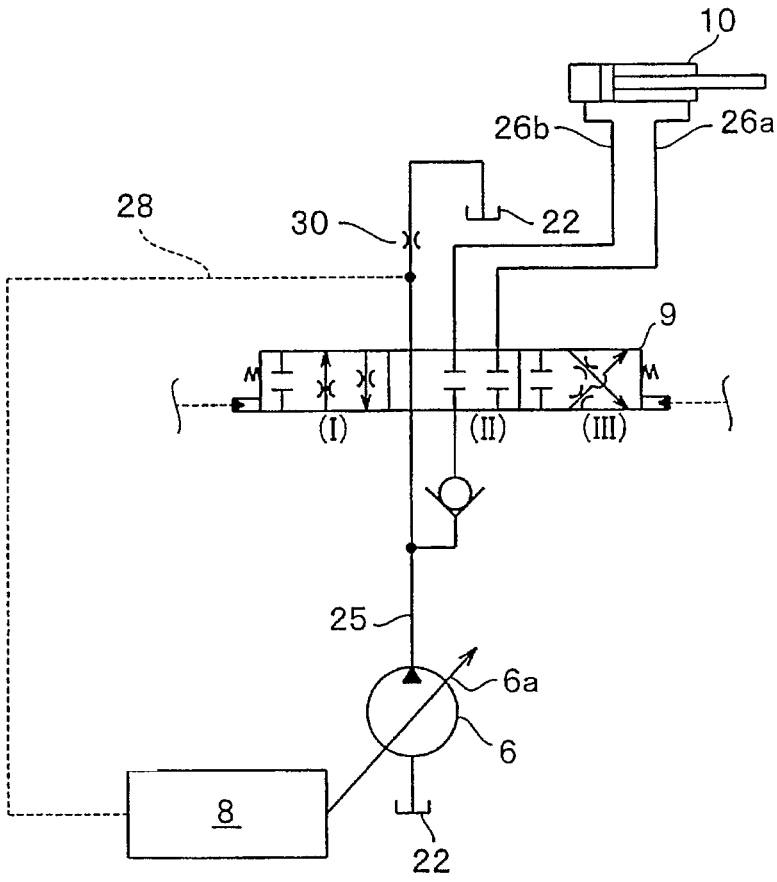
FIG. 7 is a hydraulic circuit diagram constituted as an open center type (embodiment)

As a hydraulic circuit used for construction machine such as a hydraulic shovel, an open sensor type hydraulic circuit is conventionally known. FIG. 7 shows one example of such a hydraulic circuit. A device shown with a symbol 8 in FIG. 7 is a known pump displacement control device, and its details are disclosed in Japanese Patent Application Publication No. 6-58111. FIG. 7 shows an outline of the pump control device 8. An upstream pressure of a throttle 30 provided in a center bypass circuit of a control valve 9 is introduced to the pump control device 8 of a variable displacement hydraulic pump 6 through a pilot oil passage 28.

If the control valve 9 is operated from the neutral position (II) to the position (I) or the position (III), a flow rate passing through the center bypass circuit of the control valve 9 is gradually reduced, and the pressure upstream of the throttle 30 is also gradually reduced. The pump displacement of the variable displacement hydraulic pump 6 is increased inversely proportional to the pressure upstream of the throttle 30. If the control valve 9 is completely switched to the position (I) or the position (III), the center bypass circuit is blocked and thus, the pressure upstream of the throttle 30 becomes equal to the pressure in the tank 22.

At that time, the variable displacement hydraulic pump 6 has the maximum pump displacement. Hence, by detecting that the pressure in the pilot oil passage 28 becomes equal to the pressure in the tank 22, it is possible to control the engine engine speed.

Alternatively, it is also possible to control the engine engine speed by obtaining the pump displacement of the variable displacement hydraulic pump 6 from the actually measured value of the engine speed and the engine output torque, or by obtaining the pump displacement directly by a pump swash plate angle sensor.

Therefore, the hydraulic circuit of the present invention is not limited to the load sensing type hydraulic circuit.

Returning the to the control flow in FIG. 5, explanation will be continued. If the load of the actuator 10 is reduced from its increased state, the controller 4 lowers while matching with the engine output torque on the maximum torque line R. In step 6, when the target engine speed is shifted from the second target engine speed to the third target engine speed, i.e., when the high-speed control field is shifted to the high-speed control field F3, the high-speed control field F3 is lowered from the matching point between the maximum torque line R and the high-speed control field F3.

In step 6, when the target engine speed is shifted from the second target engine speed to the first target engine speed, i.e., when the high-speed control field is shifted to the high-speed control field F1, the engine output torque is lowered to the rated torque point K1.

If the operation lever 11*a* is returned from a state where the operation lever 11*a* is deeply operated, the swash plate angle of the hydraulic pump 6 is reduced, and the controller 7 controls the fuel injector 3 to reduce the fuel injection amount. Accordingly, in the high-speed control field F3 or the high-speed control field F1, control for reducing the pump displacement of the hydraulic pump 6 from the maximum pump displacement state while matching the engine load and the engine output torque is carried out.

If the control in step 6 is carried out, the procedure is shifted to step 7.

In step 7, it is determined whether predetermined time is elapsed after control for shifting the high-speed control field F2 to a new high-speed control field F3 at the highest rotation field side (when the high-speed control field F2 is shifted to the highest rotation field side, the high-speed control field F3 matches with the high-speed control field F1) is carried out. Until the predetermined time is elapsed, the controller 7 controls such that the high-speed control field F3 is not sifted to the next high-speed control field.

As the predetermined time, it is possible to previously obtain the time by experiment, or to set the time as one cycle time in the control flow.

In step 7, until the predetermined time is elapsed, the control in step 7 is repeated, and after the predetermined time is elapsed, the procedure is shifted to step 8.

If the high-speed control field F2 is shifted to the high-speed control field F3, the engine speed is increased, and the discharge flow rate from the hydraulic pump 6 can be increased. Therefore, as the pump displacement of the hydraulic pump 6, the pump displacement in the high-speed control field F3 at the time of the shifting becomes smaller than the pump displacement in the high-speed control field F2.

Therefore, when the predetermined time is elapsed after the shifting operation from the high-speed control field F2 to the high-speed control field E'3 is completed and the pump displacement of the hydraulic pump 6 again becomes equal to or higher than the first predetermined pump displacement (e.g., the maximum pump displacement of the hydraulic pump 6), the speed control field can be shifted from the high-speed control field F3 to another high-speed control field located on the side of the high-speed control field F1. When the pump displacement of the hydraulic pump 6 again becomes equal to or higher than the first predetermined pump displacement after the speed control field is shifted to the other high-speed control field, the shifting operation to another high-speed control field located on the side of the high-speed control field F1 can be sequentially repeated.

In step 8, if the pump displacement of the hydraulic pump 6 becomes lower than the second predetermined pump displacement and there is a tendency that the pump displacement of the hydraulic pump 6 is further reduced when the controller 7 carries out control for reducing the engine output torque while matching the engine load and the engine output torque with each other in the high-speed control field F3 or the high-speed control field F1, the high-speed control field F3 or high-speed control field F1 is shifted toward the high-speed control field F2.

A point on the high-speed control field F3 or the high-speed control field F1 at that time can be set as a second set position B (i.e., second predetermined pump displacement). The second predetermined pump displacement can be set as the maximum pump displacement of the hydraulic pump 6 or can be set as a value which is equal to or less than the maximum pump displacement.

The second set position B can be set as a position when the pump displacement of the hydraulic pump 6 is reduced lower than the second predetermined pump displacement and there is a tendency that the pump displacement of the hydraulic pump 6 is reduced. Other than this, the second set position B can also be set as follows. That is, a point on the high-speed control field F3 or the high-speed control field F1 when a differential pressure between the discharge pressure of the hydraulic pump 6 and the load pressure of the actuator 10 exceeds a load sensing differential pressure which is set by the pump control device 8 can be set as the second set position B.

An operation speed of the actuator 10 when control is carried out in the high-speed control field F1 or the high-speed control field F3 and an operation speed of the actuator 10 when control is carried out in the high-speed control field F4 or the high-speed control field F5 (these are high-speed control fields shifted from the high-speed control field F1 or the high-speed control field F3, and become the high-speed control field F2 when shifted to the lowest rotation field side) can set the second set position B as position where these operation speeds can be obtained as substantially favorable state.

That is, a condition under which a reducing ratio of the operating machine speed of the actuator 10 when the operating machine is moved on the high-speed control field F1 or the high-speed control field F3 while reducing the engine output torque and while matching the engine load and the engine output torque with each other, and a reducing ratio of the operating machine speed of the actuator 10 when the speed control field is shifted to the high-speed control field F4 or the high-speed control field F5 can smoothly be connected to each other is obtained by experiment, and a position where these reducing ratios can be connected to each other smoothly can be set as the second set position B.

Using various parameter values used for specifying the first set position A, it is possible to detect when these parameter values become equal to a value at which the second set position B is previously specified.

The control is repeated in step 8 until the second set position B is detected, and if the second set position B is detected, the procedure is shifted to step 9.

In step 9, the controller 7 reduces the engine speed, and control for shifting the high-speed control field F1 (the high-speed control field F3 instead of the high-speed control field F1 if the high-speed control field F3 is set in step 6) toward the high-speed control field F2 which is located on the low rotation field side. If the pump displacement of the hydraulic pump 6 again becomes equal to or higher than the first predetermined pump displacement or becomes equal to the maximum pump displacement of the hydraulic pump 6, or if a differential pressure between the discharge pressure of the hydraulic pump 6 and the load pressure of the actuator 10 exceeds the load sensing differential pressure when shift control from the high-speed control field F1 or the high-speed control field F3 to the high-speed control field F2 is carried out, the high-speed control field at that time can be set as a new high-speed control field F4 (high-speed control field F5 when shifted from the high-speed control field F3, but the high-speed control field F5 is not shown).

That is, even if the high-speed control field F4 or the high-speed control field F5 which is set in this manner is between the high-speed control field F2 and the high-speed control field F1 or the high-speed control field F3, this new high-speed control field F4 or the high-speed control field F5 is maintained. When the above-described state does not occur, the speed control field is shifted to the high-speed control field F2.

If it becomes necessary to shift to another high-speed control field in the control in the new high-speed control field F4 or the high-speed control field F5, the speed control field is shifted from the high-speed control field F4 or the high-speed control field F5 to another high-speed control field. However, until predetermined time is elapsed after the speed control field is shifted to the high-speed control field F4 or the high-speed control field F5, the shifting operation from these high-speed control fields to another high-speed control field is prohibited by later-described step 10.

As a condition for carrying out the shifting operation at that time, the shifting operation can be carried out when the same state as that for detecting the second set position B is generated. The predetermined time in step 10 can be obtained previously by experiment or can be set as one cycle time in the control flow like the predetermined time in step 7.

When the speed control field is shifted from the high-speed control field F1 to the high-speed control field F2, control along the fine dotted line is carried out in FIG. 4. When control in a new high-speed control field F4 is carried out during the shifting operation from the high-speed control field F1 to the high-speed control field F2, the procedure is branched off from an intermediate portion of the fine dotted line in FIG. 4 and control along the new high-speed control field F4 in which the engine speed is N'4 is carried out. Control in the high-speed control field F4 is shown with the phantom line in FIG. 4. When control is carried out in the high-speed control field F1 which is carried out from the conventional technique, control as shown with the arrow of thick dotted line is carried out.

Although a state where the speed control field is shifted from the high-speed control field F3 to the high-speed control field F5 (not shown) is omitted in FIG. 4, the high-speed control field F5 (not shown) can be illustrated in the same manner as the high-speed control field F4 between the high-speed control field F3 and the high-speed control field F2.

With this, control for matching the engine load and the engine output torque with each other can be carried out in the high-speed control field F1 or a new high-speed control field F4 located on a rotation field lower than the high-speed control field F3 or the high-speed control field F5 (the high-speed control field F4 and the high-speed control field F5 become the high-speed control field F2 when shifted to the lowest rotation field). Therefore, the engine 2 can be rotated in the low rotation field side, and the fuel economy of the engine 2 can be enhanced.

A value of the pump displacement to determine the first set position A and a value of the pump displacement to determine the second set position B may be the same or different from each other. The second set position B which is shifted from the high-speed control field F1 toward the high-speed control field F2 and the second set position B which is shifted from the high-speed control field F3 toward the high-speed control field F2 may be the same or different from each other.

A position of the second set position B can be changed in accordance with a rate of change of the engine output torque T, a rate of change of the pump displacement of the hydraulic pump 6, or the rate of change of the discharge pressure P of the hydraulic pump 6. When these rates of change, i.e., when the reducing degrees are high, a position of the second set position B is set on the side of a position where the engine output torque is high, and the speed control field can be shifted to the high-speed control field F2 early.

If control in step 9 is carried out, the procedure is shifted to step 10.

In step 10, it is determined whether predetermined time is elapsed after control for shifting the high-speed control field F1 or high-speed control field F3 to a new high-speed control field F4 or high-speed control field F5 on the side of the low rotation field is carried out. The controller 7 performs control such that the speed control field is not shifted from the high-speed control field F4 or high-speed control field F5 to another high-speed control field until the predetermined time is elapsed.

If the speed control field is shifted to a higher speed control field or a high-speed control field located on a low rotation field side before the predetermined time is elapsed, shifting operation occurs frequently between the high-speed control fields. If the shifting operation frequently occurs between different high-speed control fields, there is an adverse possibility that the engine speed of the engine is varied, and operation speed of the actuator is modulated.

Therefore, in step 10, the control in step 10 is repeated until predetermined time is elapsed, and after the predetermined time is elapsed, the procedure is shifted to step 11.

In step 11, the controller 7 checks a first target engine speed corresponding to a command value in the fuel dial 4, and if the checking is completed, the procedure is shifted to step 12.

In step 12, it is determined whether a value of the first target engine speed corresponding to the command value in the fuel dial 4 is changed to a value of another target engine speed. If the value of the first target engine speed is changed, the procedure is returned to step 2, and control after step 2 is carried out. If the value of the first target engine speed is not changed, the procedure is returned to step 5, and control after step 5 is sequentially carried out.

Since controls of steps 11 and 12 are not absolutely necessary, these steps may be omitted from the control flow.

It is possible to enhance the fuel economy efficiency of the engine by the present invention, an operator can set the high-speed control field F1 in accordance with the first target engine speed which is set in correspondence with the command value in the fuel dial 4, the operator can set the second target engine speed and the high-speed control field F2 on the low rotation field side which was previously set in accordance with the set first target engine speed and high-speed control field F1, and can start the control of the engine based on the second target engine speed or the high-speed control field F2.

With this, in a field where a high engine output torque is unnecessary, the rotation of the engine can be controlled based on the second target engine speed on the low rotation field side, and the fuel economy efficiency of the engine can be enhanced. In a field where high engine output torque is required, the speed control field is shifted to the high-speed control field on the high rotation field side, and the engine can be controlled, and operation speed required for operating the operating machine can sufficiently be obtained.

When the engine output torque is reduced from the high output state of the engine, the engine speed can be shifted to the fourth target engine speed (high-speed control field F4) or fifth target engine speed (high-speed control field F5) on the low rotation field side and the engine can be controlled. Therefore, the fuel economy can be enhanced.

The fact that the present invention can suitably be applied also to the open center type hydraulic circuit has been explained using FIG. 7, and a negative control type hydraulic circuit and a positive control type hydraulic circuit are known as the open center type hydraulic circuit. An embodiment of the negative control type hydraulic circuit and the positive control type hydraulic circuit will be described in detail.

The embodiment using the negative control type hydraulic circuit will be explained using FIG. 8. Control characteristics of a negative control valve 59 in the negative control type shown in FIG. 8 will be explained using FIG. 9, and pump control characteristics in the negative control type shown in FIG. 8 will be explained using FIG. 10.

Figure 8:
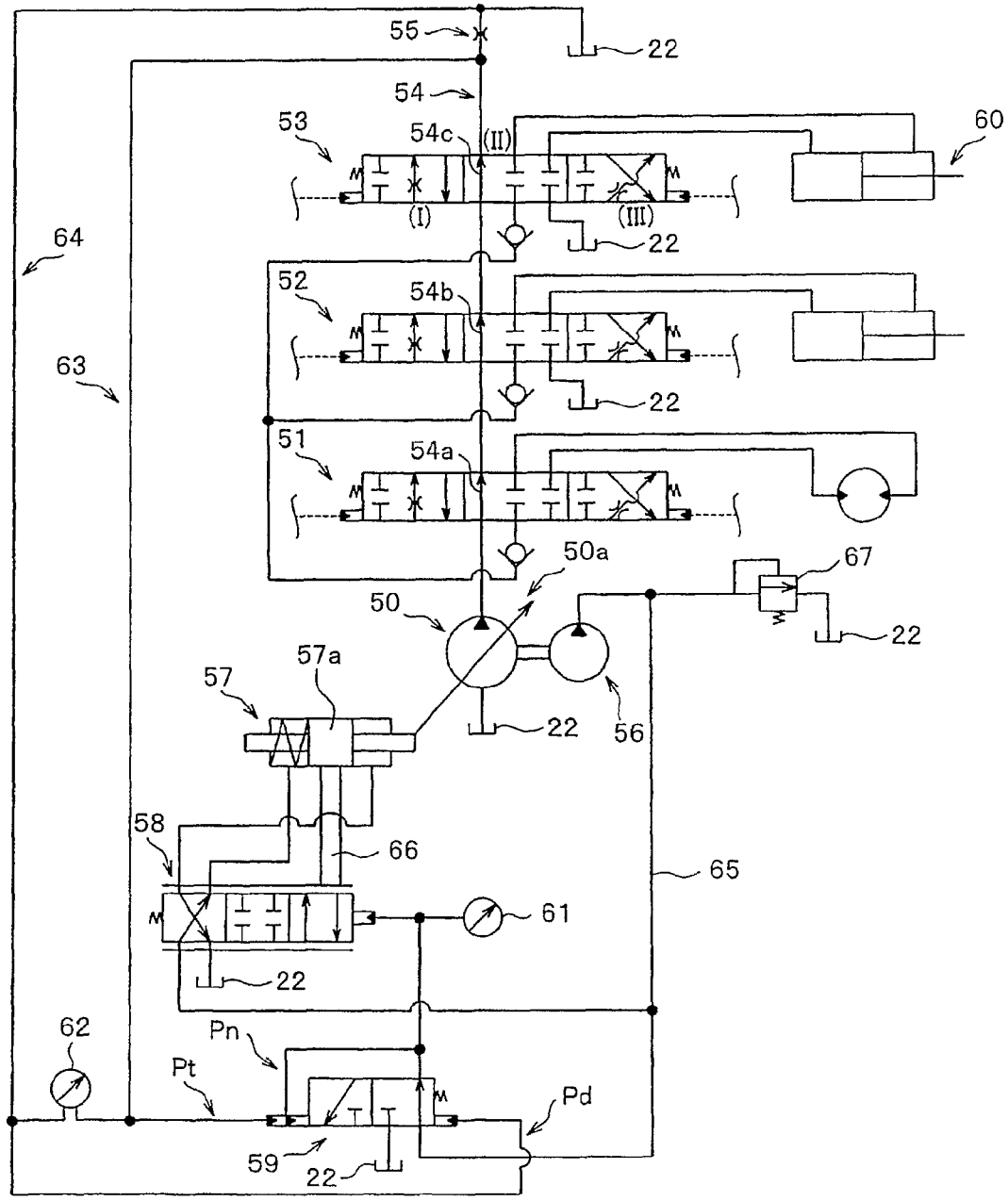
FIG. 8 is a negative control type hydraulic circuit diagram among the open center type (embodiment)

As shown in FIG. 8, in the negative control type hydraulic circuit, a variable displacement hydraulic pump 50 is rotationally driven by an engine (not shown), and discharge flow rate discharged from the variable displacement hydraulic pump 50 is supplied to a first control valve 51, a second control valve 52 and a third control valve 53. The third control valve 53 is constituted as an operation valve for operating the actuator 60. A symbol of the actuator is omitted, but the first control valve 51 and the second control valve 52 are also constituted as operation valves for operating the actuator.

In FIG. 8, pilot valves which respectively operate a first control valve 51 to a third control valve 53 can be formed into structures shown in FIG. 11 which shows a later-described positive control type hydraulic circuit, but the pilot valves are omitted in FIG. 8.

A center bypass circuit 54*a* of the first control valve 51 is connected to a center bypass circuit 54*b* of the second control valve 52, and the center bypass circuit 54*b* of the second control valve 52 is connected to a center bypass circuit 54*c* of the third control valve 53. The center bypass circuit 54*c* of the third control valve 53 is connected to a center bypass circuit 54 which is in communication with the tank 22, and the center bypass circuit 54 is provided with a throttle 55.

A pressure Pt upstream of the throttle 55 is taken out by an oil passage 63, and a pressure Pd downstream of the throttle 55 is taken out by an oil passage 64. Upstream and downstream differential pressure (Pt−Pd) of the throttle 55, i.e., a pressure difference between the oil passage 63 and the oil passage 64 can be detected by a pressure sensor 62.

A pilot hydraulic pump 56 is rotationally driven by operation of an engine (not shown). A discharge flow rate from the pilot hydraulic pump 56 is supplied to the negative control valve 59 and a servo guide valve 58. The discharge pressure from the pilot hydraulic pump 56 is adjusted such that the pressure does exceed a predetermined pressure by a relief valve 67.

A swash plate angle of a swash plate 50*a* which controls a pump displacement of the variable displacement hydraulic pump 50 is controlled by a servo actuator 57, the servo guide valve 58 and the negative control valve 59. The negative control valve 59 is constituted as a two position three port switch valve, and the pressure Pd downstream of the throttle 55 provided in the center bypass circuit 54 and a spring force act on one end of the negative control valve 59 through the oil passage 64.

The pressure Pt upstream of the throttle 55 acts on the other end of the negative control valve 59 through the oil passage 63, and an output pressure Pn from the negative control valve 59 acts on the other end of the negative control valve 59. The output pressure Pn is generated by discharge pressure from the pilot hydraulic pump 56 supplied through the oil passage 65, and is controlled by the negative control valve 59. The output pressure Pn can be detected by a pressure sensor 61.

The negative control valve 59 is switched to a switching position where a discharge flow rate from the pilot hydraulic pump 56 supplied by a spring force through an oil passage 65 is output, but if the upstream and downstream differential pressure (Pt−Pd) of the throttle 55 is increased, the negative control valve 59 is switched to a switching position where the output flow rate from the negative control valve 59 is reduced.

That is, the negative control valve 59 carries out control suitable for the upstream and downstream differential pressure (Pt−Pd) of the throttle 55. If upstream and downstream differential pressure (Pn−Pd) is increased, control for reducing the flow rate which is output from the negative control valve 59 is carried out, and when the upstream and downstream differential pressure (Pt−Pd) is reduced, control for increasing the flow rate which is output from the negative control valve 59 is carried out.

The servo guide valve 58 is constituted as a three position four port switch valve, an output pressure Pn which is output from the negative control valve 59 acts on one end of the servo spool, and a spring force acts on the other end of the servo spool. A discharge flow rate from the pilot hydraulic pump 56 is supplied through a servo operating section of the servo guide valve 58. The servo operating section of the servo guide valve 58 is connected, through a gang member 66, to a servo piston 57*a* of the servo actuator 57 which turns the swash plate 50*a* of the variable displacement hydraulic pump 50.

A port of the servo guide valve 58 and a hydraulic chamber of the servo actuator 57 are connected to each other through the servo operating section of the servo guide valve 58. The servo piston 57*a* of the servo actuator 57 biases the swash plate 50*a* toward the minimum swash plate by a biasing force of a spring.

Next, operation for controlling the pump displacement of the variable displacement hydraulic pump 50 will be explained. For example, if the third control valve 53 is operated by a pilot valve (not shown) and the third control valve 53 is operated from the neutral position (II) to the position (I) or the position (III), the center bypass circuit 54*c* of the third control valve 53 is gradually throttled. At the same time, the circuit connected to the actuator 60 is gradually opened, and the actuator 60 can be operated. As the center bypass circuit 54*c* is gradually throttled, a flow rate flowing through the center bypass circuit 54 is reduced, and the upstream and downstream differential pressure (Pt−Pd) of the throttle 55 is reduced.

If the upstream and downstream differential pressure (Pt−Pd) of the throttle 55 is reduced, the negative control valve 59 on which the upstream and downstream differential pressure (Pt−Pd) of the throttle 55 acts is switched to a right switching position shown in FIG. 8 by the biasing force of the spring. That is, as shown in FIG. 9, as the upstream and downstream differential pressure (Pt−Pd) of the throttle 55 is reduced, the output pressure Pn which is output from the negative control valve 59 is increased.

Figure 9:
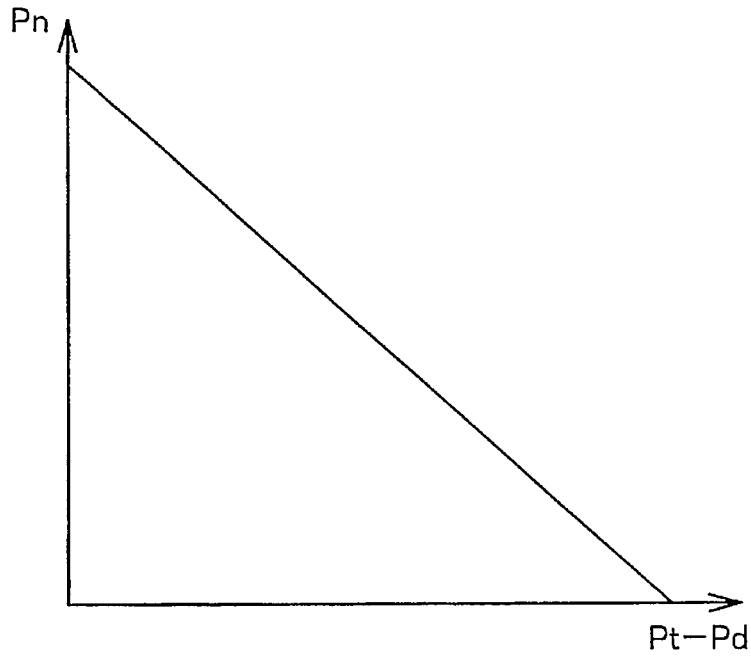
FIG. 9 is a diagram showing control characteristics of the negative control type shown in FIG. 8 (embodiment)

In FIG. 9, the horizontal axis shows the upstream and downstream differential pressure (Pt−Pd) of the throttle 55, and the vertical axis shows the output pressure Pn which is output from the negative control valve 59.

If the output pressure Pn is increased, the spool of the servo guide valve 58 slides leftward in FIG. 8, and the servo guide valve 58 is switched to the right switching position in FIG. 8. The discharge flow rate from the pilot hydraulic pump 56 supplied to the servo guide valve 58 is introduced into a right hydraulic chamber of the servo actuator 57 from the servo guide valve 58.

With this, the servo piston 57*a* of the servo actuator 57 slides leftward in FIG. 8 against the spring, and the swash plate 50*a* turns to increase the pump displacement of the variable displacement hydraulic pump 50. The swash plate angle in the variable displacement hydraulic pump 50 is controlled such that the discharge flow rate which is discharged from the variable displacement hydraulic pump 50 becomes equal to a flow rate required for operating the actuator 60.

Since the servo piston 57*a* slides leftward in FIG. 8, the servo operating section of the servo guide valve 58 slides leftward in FIG. 8 through the gang member 66, and the servo guide valve 58 is returned to the neutral position.

When the output pressure Pn from the negative control valve 59 becomes a output pressure suitable for the upstream and downstream differential pressure (Pt−Pd) of the throttle 55, the servo guide valve 58 is kept in balance and maintained at its neutral position. At that time, the sliding position in the servo piston 57*a* of the servo actuator 57 is suitable for the output pressure Pn, and the pump displacement D of the variable displacement hydraulic pump 50 can be a pump displacement D suitable for the output pressure Pn, i.e., suitable for the upstream and downstream differential pressure (Pt−Pd) of the throttle 55 as shown in FIG. 10.

Figure 10:
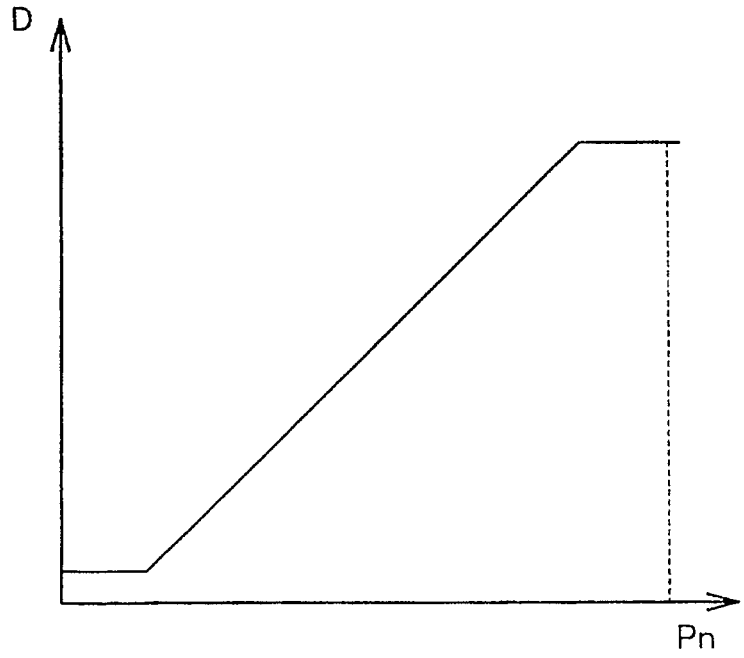
FIG. 10 is a diagram showing pump control characteristics of the negative control type shown in FIG. 8 (embodiment)

In FIG. 10, the horizontal axis shows the output pressure Pn which is output from the negative control valve 59, and the vertical axis shows the pump displacement D of the variable displacement hydraulic pump 50.

As described above, in the explanation using the open center type hydraulic circuit shown in FIG. 7, as a method for obtaining the pump displacement of the hydraulic pump, the method for obtaining the torque diagram of the engine and the actually measured value of the engine speed, and the method for obtaining the pump displacement directly by the swash plate angle sensor of the hydraulic circuit have been explained. The case in which the engine speed is controlled by detecting that the pressure in the pilot oil passage 28 becomes equal to the tank pressure has been explained, but in the negative control type hydraulic circuit shown in FIG. 8, a pressure sensor 61 which detects the output pressure Pn output from the negative control valve 59 is provided, and it is possible to know the command value D commanding the pump displacement of the variable displacement hydraulic pump utilizing the characteristics diagram in FIG. 10.

By providing the pressure sensor 62 which detects the upstream and downstream differential pressure (Pt−Pd) of the throttle 55, it is possible to know the command value D commanding the pump displacement of the variable displacement hydraulic pump 50 if the characteristics diagrams in FIGS. 9 and 10 are utilized.

Therefore, in the negative control type hydraulic circuit also, since it is possible to know the command value D commanding the pump displacement of the variable displacement hydraulic pump 50, the engine speed can be controlled. By inputting the value obtained in this manner into the controller 7 shown in FIG. 1, the engine speed can be controlled.

In FIG. 8, when the engine speed of an engine (not shown) which drives the variable displacement hydraulic pump 50 is set to a low speed side, the center bypass flow rate passing through the throttle 55 of the center bypass circuit 54 is reduced. With this, the upstream and downstream differential pressure (Pn−Pd) of the throttle 55 is reduced, and the output pressure Pn which is output from the negative control valve 59 is increased as shown in FIG. 9. Based on the characteristics diagram in FIG. 10, the pump displacement D of the variable displacement hydraulic pump 50 is increased.

Even if the engine speed of the engine is set to the low speed side in this manner, the pump displacement D can be controlled in the same manner as that when the engine speed is set to other than the low speed side. This means that even if the engine speed is set to the low speed side in the same manner as the load sensing type hydraulic circuit, the pump displacement D can be controlled in the same manner as that when the engine speed is set to other than the low speed side.

Next, an embodiment using a positive control type hydraulic circuit will be explained using FIG. 11. The pump control characteristics of the positive control type shown in FIG. 11 will be explained using FIG. 12. In the positive control type hydraulic circuit, the same constituent members as those of the negative control type hydraulic circuit shown in FIG. 8 are designated with the same symbols, and explanation thereof will be omitted.

Figure 11:
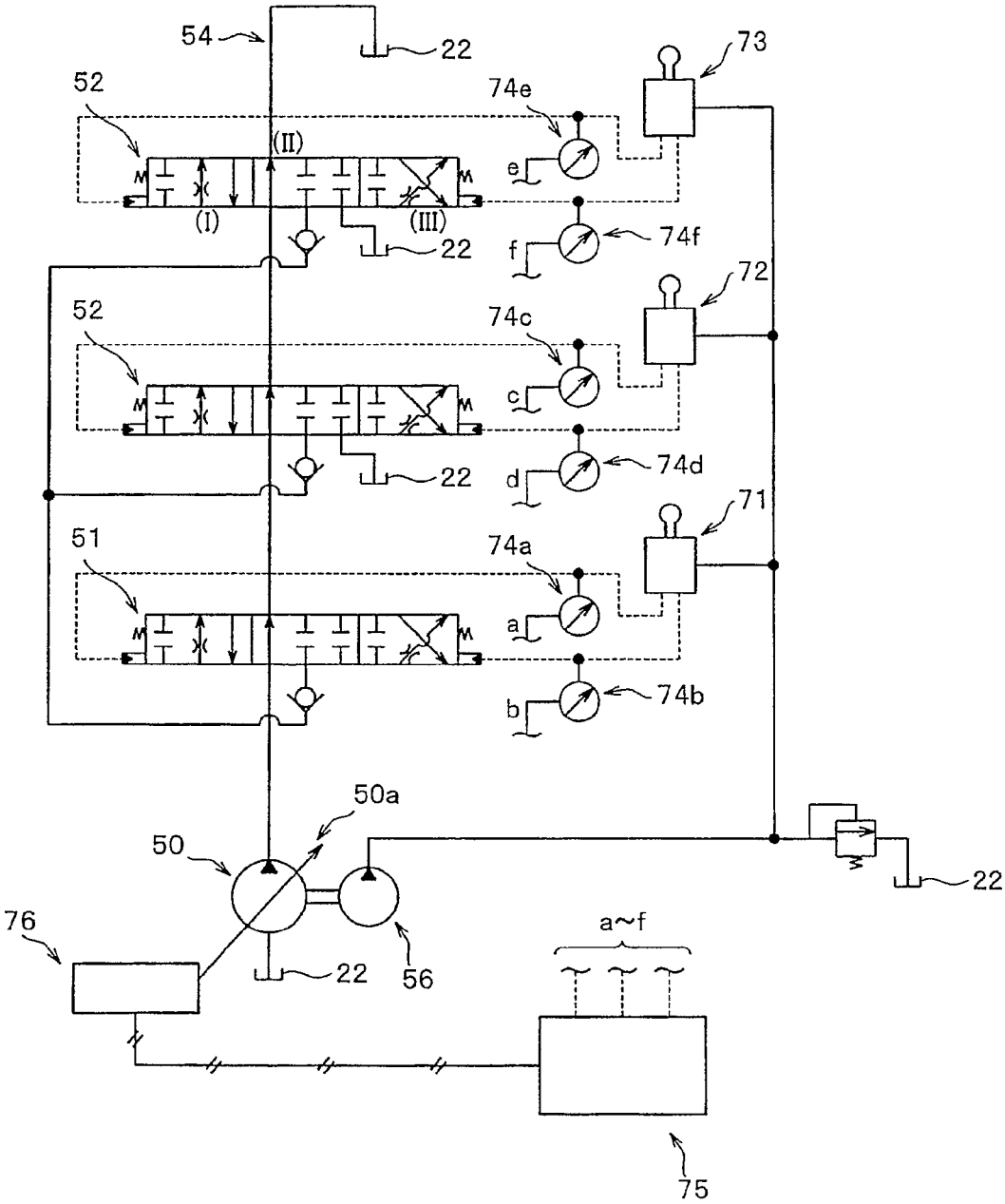
FIG. 11 is a positive control type hydraulic circuit diagram among the open center type (embodiment)
Figure 12:
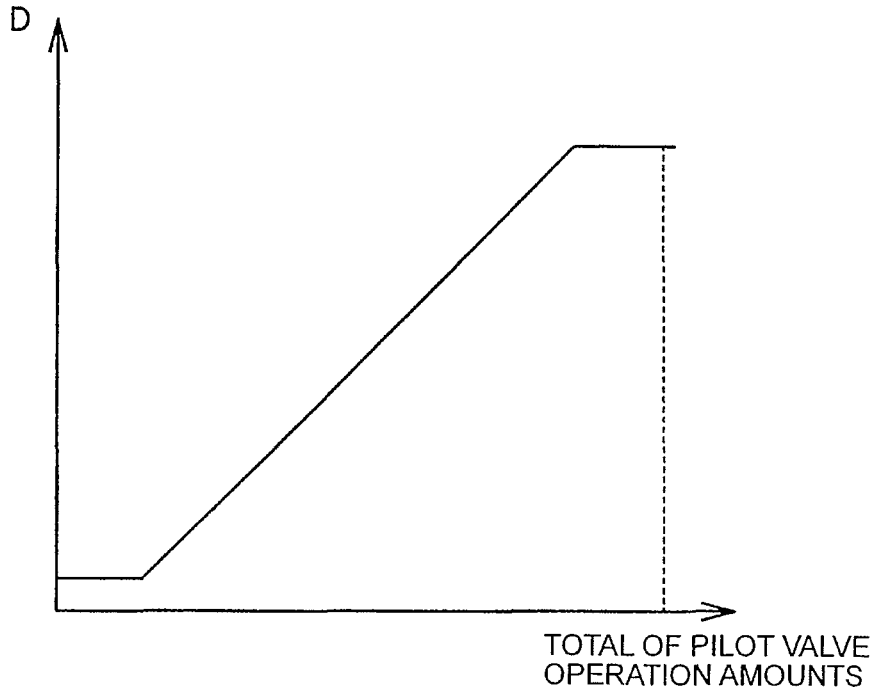
FIG. 12 is a diagram showing pump control characteristics in positive control type shown in FIG. 11 (embodiment).

As shown in FIG. 11, a first pilot valve 71, a second pilot valve 72 and a third pilot valve 73 which respectively operate the first control valve 51, the second control valve 52 and the third control valve 53 are illustrated in the positive control type hydraulic circuit. By respectively operating the first pilot valve 71 to the third pilot valve 73, the discharge pressure oil from the pilot hydraulic pump 56 can be applied to spools of the first control valve 51 to the third control valve 53 through tubes shown with broken lines.

The corresponding first control valve 51 to the third control valve 53 can be controlled in accordance with operation amounts and operation directions in the first pilot valve 71 to the third pilot valve 73.

The operation amounts in the first pilot valve 71 to the third pilot valve 73 can be detected by pressure sensors 74*a* to 74*f* respectively provided in tubes which are shown with the broken lines and which connect the first pilot valve 71 to the third pilot valve 73 and the first control valve 51 to the third control valve 53.

Detection pressure detected by the pressure sensors 74*a* to 74*f* is input to the controller 75 through harnesses a to f. When the first control valve 51 to the third control valve 53 are operated a plurality of times, the detection pressure from the detected pressure sensors 74*a* to 74*f* are input to the controller 75, respectively. In the controller 75, a total value of the plurality of input detection pressures is computed, and the command value D of the pump displacement corresponding to the total value is determined from the total value of the detection pressures shown with the horizontal axis in FIG. 12.

The command value D of the determined pump displacement is output to a pump control device 76, and the pump control device 76 is controlled such that the pump displacement of the variable displacement hydraulic pump 50 becomes equal to the command value D. For example, when the first pilot valve 71 and the second pilot valve 72 are operated, the discharge flow rate from the variable displacement hydraulic pump 50 is supplied to an actuator (not shown) through the first control valve 51 and the second control valve 52.

In the case of the above-described example, if the first pilot valve 71 and the second pilot valve 72 are not operated to the full stroke, since the first control valve 51 and the second control valve 52 which are respectively operated by the first pilot valve 71 and the second pilot valve 72 are not switched to the full stroke position, excessive oil is returned to the tank 22 through the center bypass circuit 54.

Therefore, in the positive control type hydraulic circuit also, the speeds of the actuators operated by the first pilot valve 71 to the third pilot valve 73 can be controlled by operating the first pilot valve 71 to the third pilot valve 73.

Furthermore, since the command value D of the pump displacement of the positive control type is determined by the controller 75, the engine speed can be controlled using the command value D of the pump displacement determined by the controller 75.

Therefore, the hydraulic circuit of the present invention is not limited to the load sensing type hydraulic circuit, and the invention can preferably be applied to the open center type hydraulic circuit, and also the negative control type hydraulic circuit and the positive control type hydraulic circuit in the open center type hydraulic circuit.

INDUSTRIAL APPLICABILITY

The technical idea of the present invention can be applied to the engine control of a diesel engine.

The invention claimed is:

1. An engine control device comprising:

at least one variable displacement hydraulic pump which is driven by an engine;

at least one hydraulic actuator which is driven by discharge pressure oil from the variable displacement hydraulic pump;

a control valve which controls the pressure oil discharged from the variable displacement hydraulic pump and supplies and discharges the pressure oil to and from the hydraulic actuator; and pump displacement detecting means for detecting a pump displacement of the variable displacement hydraulic pump, wherein the engine control device is characterized by further comprising command means for selecting and commanding one of command values that can be variably commanded, and setting means for setting a first target engine speed in accordance with a command value commanded by the command means, and setting a second target engine speed which is lower than the first target engine speed based on the set first target engine speed, wherein when the pump displacement detected by the pump displacement detecting means increases and exceeds a first predetermined pump displacement when the engine is controlled at an engine speed which is lower than the first target engine speed based on the second target engine speed, a target engine speed is changed from the second target engine speed to a third target engine speed which is higher than the second target engine speed and which is equal to or lower than the first target engine speed.

2. The engine control device according to claim 1, wherein it is prohibited to further change the third target engine speed for a predetermined time after the target engine speed is changed to the third target engine speed.

3. The engine control device according to claim 2, wherein the third target engine speed and the first target engine speed are equal to each other.

4. The engine control device according to claim 1, wherein the third target engine speed and the first target engine speed are equal to each other.

5. An engine control device comprising:

at least one variable displacement hydraulic pump which is driven by an engine;

at least one hydraulic actuator which is driven by discharge pressure oil from the variable displacement hydraulic pump;

a control valve which controls the pressure oil discharged from the variable displacement hydraulic pump and supplies and discharges the pressure oil to and from the hydraulic actuator; and pump displacement detecting means for detecting a pump displacement of the variable displacement hydraulic pump, wherein the engine control device is characterized by further comprising command means for selecting and commanding one of command values that can be variably commanded, and setting means for setting a first target engine speed in accordance with a command value commanded by the command means, and setting a second target engine speed which is lower than the first target engine speed based on the set first target engine speed, wherein when the pump displacement detected by the pump displacement detecting means decreases lower than a second predetermined pump displacement when the engine is controlled based on the first target engine speed, a target engine speed is changed from the first target engine speed to a fourth target engine speed which is lower than the first target engine speed and which is equal to or higher than the second target engine speed.

6. The engine control device according to claim 5, wherein it is prohibited to further change the fourth target engine speed for a predetermined time after the target engine speed is changed to the fourth target engine speed.

7. The engine control device according to claim 6, wherein the fourth target engine speed and the second target engine speed are equal to each other.

8. The engine control device according to claim 5, wherein the fourth target engine speed and the second target engine speed are equal to each other.

9. An engine control device comprising:

at least one variable displacement hydraulic pump which is driven by an engine;

at least one hydraulic actuator which is driven by discharge pressure oil from the variable displacement hydraulic pump;

a control valve which controls the pressure oil discharged from the variable displacement hydraulic pump and supplies and discharges the pressure oil to and from the hydraulic actuator; and pump displacement detecting means for detecting a pump displacement of the variable displacement hydraulic pump, wherein the engine control device is characterized by further comprising command means for selecting and commanding one of command values that can be variably commanded, and setting means for setting a first target engine speed in accordance with a command value commanded by the command means, and setting a second target engine speed which is lower than the first target engine speed based on the set first target engine speed, wherein when the pump displacement detected by the pump displacement detecting means increases and exceeds a first predetermined pump displacement when the engine is controlled at an engine speed which is lower than the first target engine speed based on the second target engine speed, a target engine speed is changed from the second target engine speed to third target engine speed which is higher than the second target engine speed and which is equal to or lower than the first target engine speed, and when the pump displacement detected by the pump displacement detecting means decreases lower than a second predetermined pump displacement when the engine is controlled based on the third target engine speed, the target engine speed is changed from the third target engine speed to a fifth target engine speed which is lower than the third target engine speed and which is equal to or higher than the second target engine speed.

10. The engine control device according to claim 9, wherein it is prohibited to further change the third target engine speed for a predetermined time after the target engine speed is changed to the third target engine speed, and it is prohibited to further change the fifth target engine speed for a predetermined time after the target engine speed is changed to the fifth target engine speed.

11. The engine control device according to claim 10, wherein the third target engine speed and the first target engine speed are equal to each other and/or the fifth target engine speed and the second target engine speed are equal to each other.

12. The engine control device according to claim 9, wherein the third target engine speed and the first target engine speed are equal to each other and/or the fifth target engine speed and the second target engine speed are equal to each other.

13. An engine control method in a control device comprising:

at least one variable displacement hydraulic pump which is driven by an engine;

at least one hydraulic actuator which is driven by discharge pressure oil from the variable displacement hydraulic pump;

a control valve which controls the pressure oil discharged from the variable displacement hydraulic pump and supplies and discharges the pressure oil to and from the hydraulic actuator; and pump displacement detecting means for detecting a pump displacement of the variable displacement hydraulic pump, wherein the engine control method is characterized by comprising steps of:

selecting one of command values that can be variably commanded and setting a first target engine speed in accordance with the selected command value;

setting a second target engine speed which is lower than the first target engine speed based on the set first target engine speed; and changing a target engine speed from the second target engine speed to a third target engine speed which is higher than the second target engine speed and which is equal to or lower than the first target engine speed when the pump displacement detected by the pump displacement detecting means increases and exceeds a first predetermined pump displacement when the engine is controlled at an engine speed which is lower than the first target engine speed based on the second target engine speed.

14. The engine control method according to claim 13, wherein it is prohibited to further change the third target engine speed for a predetermined time after the target engine speed is changed to the third target engine speed.

15. The engine control method according to claim 14, wherein a value of the first predetermined pump displacement can be changed in accordance with a rate of change of an engine output torque or a rate of change of the pump displacement.

16. The engine control method according to claim 13, wherein a value of the first predetermined pump displacement can be changed in accordance with a rate of change of an engine output torque or a rate of change of the pump displacement.

17. An engine control method in a control device comprising: at least one variable displacement hydraulic pump which is driven by an engine;

at least one hydraulic actuator which is driven by discharge pressure oil from the variable displacement hydraulic pump;

a control valve which controls the pressure oil discharged from the variable displacement hydraulic pump and supplies and discharges the pressure oil to and from the hydraulic actuator; and pump displacement detecting means for detecting a pump displacement of the variable displacement hydraulic pump, wherein the engine control method is characterized by comprising steps of:

selecting one of command values that can be variably commanded and setting a first target engine speed in accordance with the selected command value;

setting second target engine speed which is lower than the first target engine speed based on the set first target engine speed; and changing the engine target rotation number from the first target engine speed to a fourth target engine speed which is lower than the first target engine speed and which is equal to or higher than the second target engine speed when the pump displacement detected by the pump displacement detecting means decreased and becomes lower than a second predetermined pump displacement when the engine is controlled based on the first target engine speed.

18. The engine control method according to claim 17, wherein it is prohibited to further change the fourth target engine speed for a predetermined time after the target engine speed is changed to the fourth target engine speed.

19. The engine control method according to claim 18, wherein a value of the second predetermined pump displacement can be changed in accordance with a rate of change of an engine output torque or a rate of change of the pump displacement.

20. The engine control method according to claim 17, wherein a value of the second predetermined pump displacement can be changed in accordance with a rate of change of an engine output torque or a rate of change of the pump displacement.

21. An engine control method in a control device comprising:

at least one variable displacement hydraulic pump which is driven by an engine;

at least one hydraulic actuator which is driven by discharge pressure oil from the variable displacement hydraulic pump;

a control valve which controls the pressure oil discharged from the variable displacement hydraulic pump and supplies and discharges the pressure oil to and from the hydraulic actuator; and pump displacement detecting means for detecting a pump displacement of the variable displacement hydraulic pump, wherein the engine control method is characterized by comprising steps of:

selecting one of command values that can be variably commanded and setting a first target engine speed in accordance with the selected command value;

setting a second target engine speed which is lower than the first target engine speed based on the set first target engine speed;

changing the target engine speed from the second target engine speed to a third target engine speed which is higher than the second target engine speed and which is equal to or lower than the first target engine speed when the pump displacement detected by the pump displacement detecting means increases and exceeds a first predetermined pump displacement when the engine is controlled at an engine speed which is lower than the first target engine speed based on the second target engine speed; and changing the target engine speed from the third target engine speed to a fifth target engine speed which is lower than the third target engine speed and which is equal to or higher than the second target engine speed when the pump displacement detected by the pump displacement detecting means decreases and becomes lower than a second predetermined pump displacement when the engine is controlled based on the third target engine speed.

22. The engine control method according to claim 21, wherein it is prohibited to further change the third target engine speed for a predetermined time after the target engine speed is changed to the third target engine speed, and it is prohibited to further change the fifth target engine speed for a predetermined time after the target engine speed is changed to the fifth target engine speed.

23. The engine control method according to claim 22, wherein it is possible to change a value of the first predetermined pump displacement which is a reference for changing the second target engine speed to the third target engine speed in accordance with a rate of change of an engine output torque or a rate of change of the pump displacement, and it is possible to change a value of the second predetermined pump displacement which is a reference for changing the third target engine speed to the fifth target engine speed in accordance with the rate of change of the engine output torque or the rate of change of the pump displacement.

24. The engine control method according to claim 21, wherein it is possible to change a value of the first predetermined pump displacement which is a reference for changing the second target engine speed to the third target engine speed in accordance with a rate of change of an engine output torque or a rate of change of the pump displacement, and it is possible to change a value of the second predetermined pump displacement which is a reference for changing the third target engine speed to the fifth target engine speed in accordance with the rate of change of the engine output torque or the rate of change of the pump displacement.

* * * * *